US010040662B2

(12) United States Patent
Abe et al.

(10) Patent No.: US 10,040,662 B2
(45) Date of Patent: Aug. 7, 2018

(54) SHEET PROCESSING APPARATUS AND IMAGE FORMING APPARATUS

(71) Applicant: CANON KABUSHIKI KAISHA, Tokyo (JP)

(72) Inventors: Hideto Abe, Toride (JP); Yusuke Obuchi, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/874,219

(22) Filed: Jan. 18, 2018

(65) Prior Publication Data

US 2018/0141776 A1 May 24, 2018

Related U.S. Application Data

(62) Division of application No. 14/727,039, filed on Jun. 1, 2015, now Pat. No. 9,908,736, which is a division (Continued)

(30) Foreign Application Priority Data

Sep. 20, 2012 (JP) ..... 2012-207101
Aug. 8, 2013 (JP) ..... 2013-165554

(51) Int. Cl.
*B65H 37/04* (2006.01)
*G03G 15/00* (2006.01)

(Continued)

(52) U.S. Cl.
CPC ..... *B65H 37/04* (2013.01); *B42B 4/00* (2013.01); *B42B 5/00* (2013.01); *B65H 5/068* (2013.01);

(Continued)

(58) Field of Classification Search
CPC ..... A01B 12/006; B65H 39/00; B65H 37/04; B65H 31/26; G03G 15/6541;

(Continued)

(56) References Cited

U.S. PATENT DOCUMENTS 4,946,154 A 8/1990 Nakamura
5,187,534 A 2/1993 Iwata et al.

(Continued)

FOREIGN PATENT DOCUMENTS

CN 102190200 A 9/2011
CN 102275762 A 12/2011

(Continued)

OTHER PUBLICATIONS

U.S. Appl. No. 14/100,131, filed Dec. 9, 2013.

(Continued)

*Primary Examiner* — Patrick H Mackey
(74) *Attorney, Agent, or Firm* — Fitzpatrick, Cella, Harper & Scinto

(57) ABSTRACT

A sheet processing apparatus in which a sheet bundle including a plurality of sheets discharged onto an intermediate processing tray is received in a receiving portion of a stapler and bound with use of a staple, and a sheet bundle including a plurality of sheets discharged onto the intermediate processing tray is received in a receiving portion of a staple-less binding unit having a gap in the thickness direction of the sheets smaller than that of the receiving portion of the stapler and bound without using a staple, wherein when the stapler performs the binding process, the staple-less binding unit is arranged in a position shifted in a width direction orthogonal to a sheet discharge direction from a region on the intermediate processing tray, through which the sheets discharged by a sheet discharging portion pass.

14 Claims, 17 Drawing Sheets

Related U.S. Application Data of application No. 14/031,116, filed on Sep. 19, 2013, now Pat. No. 9,126,794.

(51) Int. Cl.

| | |
|---|---|
| ***B42B 5/00*** | (2006.01) |
| ***B65H 31/26*** | (2006.01) |
| ***B65H 5/06*** | (2006.01) |
| ***B42B 4/00*** | (2006.01) |
| ***B65H 31/34*** | (2006.01) |
| ***B65H 39/00*** | (2006.01) |

(52) U.S. Cl.

CPC ..... *B65H 31/26* (2013.01); *B65H 31/34* (2013.01); *B65H 39/00* (2013.01); *G03G 15/6541* (2013.01); *G03G 2215/00827* (2013.01)

(58) Field of Classification Search

CPC ..... G03G 2215/00827; B42B 4/00; B65G 5/068; B65G 31/34

USPC ..... 270/58.08, 58.09; 399/410

See application file for complete search history.

(56) References Cited

U.S. PATENT DOCUMENTS

| | | | | |
|---|---|---|---|---|
| 5,592,280 | A | 1/1997 | Ishizuki et al. | |
| 6,550,757 | B2 | 4/2003 | Sesek | |
| 6,557,842 | B2 | 5/2003 | Conard-White et al. | |
| 8,177,214 | B2 | 5/2012 | Sato | |
| 8,246,033 | B2 | 8/2012 | Sato | |
| 8,262,075 | B2 | 9/2012 | Shiraishi | |
| 8,297,610 | B2 | 10/2012 | Shiraishi | |
| 8,342,497 | B2 | 1/2013 | Abe | |
| 8,342,499 | B2 | 1/2013 | Shiraishi et al. | |
| 8,444,133 | B2 | 5/2013 | Kimura | |
| 8,459,629 | B2 | 6/2013 | Abe | |
| 9,126,794 | B2 | 9/2015 | Abe et al. | |
| 9,908,736 | B2 * | 3/2018 | Abe | B65H 37/04 |
| 2011/0140335 | A1 | 6/2011 | Abe | |
| 2011/0222945 | A1 | 9/2011 | Sato | |
| 2011/0233844 | A1 | 9/2011 | Shiraishi et al. | |
| 2011/0304089 | A1 * | 12/2011 | Kimura | B31F 5/027 270/58.08 |
| 2011/0304090 | A1 | 12/2011 | Kimura | |
| 2012/0018943 | A1 * | 1/2012 | Shiraishi | B65H 37/04 270/58.08 |
| 2012/0034009 | A1 | 2/2012 | Sato | |
| 2012/0090441 | A1 | 4/2012 | Abe | |
| 2013/0214470 | A1 | 8/2013 | Yokomizo | |
| 2013/0264762 | A1 | 10/2013 | Matsushita et al. | |
| 2013/0341856 | A1 | 12/2013 | Takemasa et al. | |
| 2014/0001693 | A1 | 1/2014 | Ishizuka | |
| 2014/0003852 | A1 | 1/2014 | Abe | |

FOREIGN PATENT DOCUMENTS

| | | | |
|---|---|---|---|
| CN | 102275763 | A | 12/2011 |
| CN | 102346393 | A | 2/2012 |
| JP | H02-023158 | A | 1/1990 |
| JP | 2000-318918 | A | 11/2000 |
| JP | 2005-074858 | A | 3/2005 |
| JP | 3885410 | B2 | 2/2007 |
| JP | 2011-184153 | A | 9/2011 |
| JP | 2011-207560 | A | 10/2011 |
| JP | 2011-256009 | A | 12/2011 |

OTHER PUBLICATIONS

Office Action dated Oct. 19, 2015, in Korean Patent Application No. 10-2013-0112121.

Office Action dated Feb. 21, 2017, in Japanese Patent Application No. 2013-165554.

Office Action dated May 3, 2017, in Chinese Patent Application No. 201610379445.4.

Office Action dated Jun. 24, 2015, in Chinese Patent Application No. 201310416801.1.

Search Report dated Jan. 3, 2018, in European Patent Application No. 13184849.1.

* cited by examiner

SHEET PROCESSING APPARATUS AND IMAGE FORMING APPARATUS

This is a divisional of U.S. patent application Ser. No. 14/727,039, filed Jun. 1, 2015, which is a divisional of U.S. patent application Ser. No. 14/031,116, filed Sep. 19, 2013, now U.S. Pat. No. 9,126,794.

BACKGROUND OF THE INVENTION

Field of the Invention

The present invention relates to a sheet processing apparatus and an image forming apparatus, and more particularly, to a sheet processing apparatus and an image forming apparatus which are configured to bind sheets with use of a binding unit of different types.

Description of the Related Art

Hitherto, in image forming apparatus such as copying machines, laser beam printers, fax machines and multifunctional peripherals have included a sheet processing apparatus configured to bind sheets. In such a sheet processing apparatus, a sheet bundle, including a plurality of sheets, is bound using a metal staple. Such a stapling process can reliably bind a plurality of output sheets at a position specified by a user, and hence this process is adopted in many sheet processing apparatus.

Further, in conventional sheet processing apparatus, there has been proposed an apparatus including, in addition to the binding unit using a staple, a binding unit configured to simply bind the sheets without using a staple, on the presumption that "unbinding" of the sheet bundle is to be performed after the binding (see Japanese Patent Application Laid-Open No. 2000-318918). This apparatus includes, in addition to the staple binding unit configured to fasten a maximum of 50 sheets by a staple, a binding unit, as an example of staple-less binding unit, configured to perform simple binding of up to about 10 sheets by forming a half-blanking shaped fastening portion in a sheet bundle. When binding is to be performed in such a sheet processing apparatus, a selective moving mechanism selectively moves each of the binding unit arranged to be movable forward and backward to a binding position of the sheet bundle.

Such a conventional sheet processing apparatus includes the selective moving mechanism for selectively moving each binding unit to the binding position, and hence the configuration of the apparatus becomes complicated. In order to prevent this, the following configurations may be considered. For example, at least the staple-less binding unit is fixed to eliminate the selective moving mechanism.

By the way, when the maximum number of bindable sheets differs between the respective binding units as described above, generally, the height (width in an up-down direction) of a sheet receiving portion (hereinafter referred to as "opening") opened in the thickness direction of the sheet bundle also differs depending on the maximum number of bindable sheets. Therefore, depending on the fixing positions at which the respective binding units are fixed and depending on the thickness of the sheet bundle when the binding is performed with, for example, the staple binding unit having a larger opening height (a larger maximum number of bindable sheets), the sheet bundle interferes with the staple-less binding unit having a smaller opening height (a smaller maximum number of bindable sheets).

SUMMARY OF THE INVENTION

The present invention has been made in view of such an actual situation, and has an object to provide a sheet processing apparatus and an image forming apparatus which are capable of performing a binding process without requiring the upsizing of the apparatus and the lowering of the binding process efficiency, even when binding units are used that differ in receiving portion height.

According to one embodiment of the present invention, there is provided a sheet processing apparatus, including: a sheet stacking portion arranged to receive sheets; a sheet discharging portion configured to discharge the sheets onto the sheet stacking portion; a first binding unit including a first receiving portion having a gap in a thickness direction of the sheets and being configured to receive the sheets discharged onto the sheet stacking portion by the sheet discharging portion, the first binding unit being arranged to perform a binding process, using a staple, on a sheet bundle including a plurality of the sheets received in the gap of the first receiving portion; a second binding unit including a second receiving portion having a gap in a thickness direction of the sheets, the gap being smaller than the gap of the first receiving portion, the second binding unit being arranged to perform a binding process, without using a staple, on a sheet bundle including a plurality of the sheets received in the gap of the second receiving portion; and a moving unit configured to move a sheet, discharged onto the sheet stacking portion, wherein, in the case that a sheet is moved into the first receiving portion, the second binding unit is arranged in a position in which the sheets moved into the first receiving portion by the moving unit do not enter the second receiving portion.

As in the one embodiment of the present invention, by arranging the second binding unit in the position at which the sheets, moved into the first receiving portion of the first binding unit, do not enter the second receiving portion of the second binding unit, even when the binding unit which differ in height of the receiving portion are used, the binding process may be performed without upsizing the apparatus and lowering the binding process efficiency.

Further features of the present invention will become apparent from the following description of exemplary embodiments with reference to the attached drawings.

DESCRIPTION OF THE EMBODIMENTS

Now, embodiments of the present invention will be described in detail with reference to the drawings. Each of the embodiments of the present invention described below can be implemented solely or as a combination of a plurality of the embodiments or features thereof where necessary or where the combination of elements or features from individual embodiments in a single embodiment is beneficial.

Figure 1:
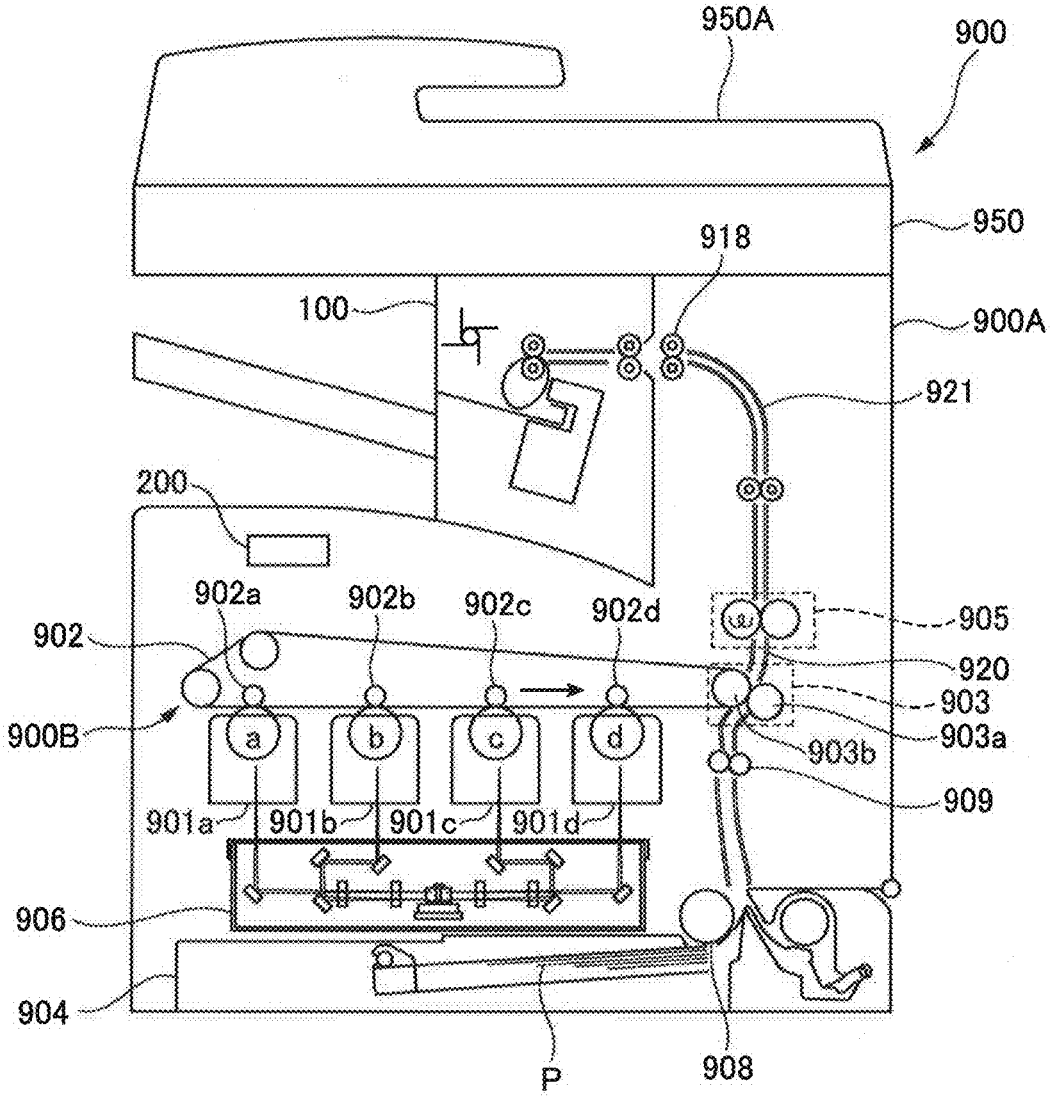
FIG. 1 is a view illustrating a configuration of an image forming apparatus including a sheet processing apparatus according to a first embodiment of the present invention.

FIG. 1 is a view illustrating a configuration of an image forming apparatus including a sheet processing apparatus according to a first embodiment of the present invention. In FIG. 1, an image forming apparatus 900 includes an image forming apparatus main body (hereinafter referred to as "apparatus main body") 900A and an image forming portion 900B configured to form an image on a sheet. On the upper portion of the apparatus main body 900A, an image reading apparatus 950 including a document feeder 950A is provided, and a finisher 100 serving as a sheet processing apparatus is arranged between the upper side of the apparatus main body 900A and the image reading apparatus 950.

In this case, the image forming portion 900B includes photosensitive drums "a" to "d" configured to form toner images of four colors of yellow, magenta, cyan, and black, and an exposure device 906 configured to form electrostatic latent images on the photosensitive drums by emitting laser beams based on image information. Note that, the photosensitive drums "a" to "d" are respectively driven by motors (not shown), and are respectively provided with primary charging devices (not shown), developing devices (not shown), and transfer charging devices 902*a* to 902*d* arranged so as to surround the respective photosensitive drums. Those members are incorporated into process cartridges 901*a* to 901*d* as units.

An intermediate transfer belt 902 is driven to rotate in a direction indicated by an arrow. By the transfer charging devices 902*a* applying transfer biases to 902*d* to the intermediate transfer belt 902, the toner images of respective colors, which are formed on the photosensitive drums, are sequentially transferred on the intermediate transfer belt 902 in a multilayered manner. With this, a full color image is formed on the intermediate transfer belt.

A secondary transfer portion 903 transfers the full color image sequentially formed on the intermediate transfer belt 902 onto a sheet P. The secondary transfer portion 903 includes a secondary transfer opposing roller 903*b* configured to support the intermediate transfer belt 902, and a secondary transfer roller 903*a* which abuts against the secondary transfer opposing roller 903*b* across the intermediate transfer belt 902. Further, there are provided registration rollers 909, a sheet feeding cassette 904, and a pick-up roller 908 configure to feed the sheet P received in the sheet feeding cassette 904. A CPU circuit portion 200 serving as a control portion controls the apparatus main body 900A and the finisher 100.

Next, an image forming operation of the image forming apparatus 900 configured as described above will be described. When the image forming operation is started, first, the exposure device 906 emits laser light based on the image information from a personal computer (not shown) or the like, to thereby sequentially expose the surfaces of the photosensitive drums "a" to "d", which have been uniformly charged at a predetermined polarity and potential. Thus, electrostatic latent images are formed on the photosensitive drums "a" to "d". After that, the electrostatic latent images are developed with toner to be visualized.

For example, first, the photosensitive drum "a" is irradiated with laser light via a polygon mirror and the like of the exposure device 906 based on the image signal for yellow component color of the document, to thereby form an electrostatic latent image for yellow on the photosensitive drum "a". Then, the electrostatic latent image for yellow is developed with yellow toner supplied from the developing device to be visualized as a yellow toner image. After that, along with the rotation of the photosensitive drum "a", the toner image arrives at a primary transfer portion at which the photosensitive drum "a" and the intermediate transfer belt 902 abut against each other. In this case, when the toner image arrives at the primary transfer portion as described above, due to a primary transfer bias applied to the transfer charging device 902*a*, the yellow toner image on the photosensitive drum "a" is transferred onto the intermediate transfer belt 902 (primary transfer).

Next, when a part of the intermediate transfer belt 902 bearing the yellow toner image moves, a magenta toner image which has been formed by this time on the photosensitive drum "b" by a method similar to the above is transferred onto the intermediate transfer belt 902 from above the yellow toner image. Similarly, as the intermediate transfer belt 902 moves, a cyan toner image and a black toner image are transferred onto the yellow toner image and the magenta toner image in an overlapped manner at the respective primary transfer portions. With this, a full color toner image is formed on the intermediate transfer belt 902.

Further, in parallel with the toner image forming operation, the sheets P contained in the sheet feeding cassette 904 are sent one by one by the pick-up roller 908. Then, the sheet P arrives at the registration rollers 909, and after the timing is adjusted by the registration rollers 909, the sheet P is conveyed to the secondary transfer portion 903. After that, at the secondary transfer portion 903, due to a secondary transfer bias to be applied to the secondary transfer roller 903*a* serving as a transfer portion, the toner images of four colors, which are formed on the intermediate transfer belt 902, are collectively transferred onto the sheet P (secondary transfer).

Next, the sheet P having the toner images transferred thereon is guided by a conveyance guide 920 from the secondary transfer portion 903 to be conveyed to a fixing portion 905. When the sheet P passes through the fixing portion 905, the sheet P receives heat and pressure so that the toner image is fixed to the sheet P. After that, the sheet P having the image fixed thereto as described above passes through a discharge path 921 provided on the downstream of the fixing portion 905. Then, the sheet P is discharged by a discharge roller pair 918, and conveyed to the finisher 100.

Figure 2A:
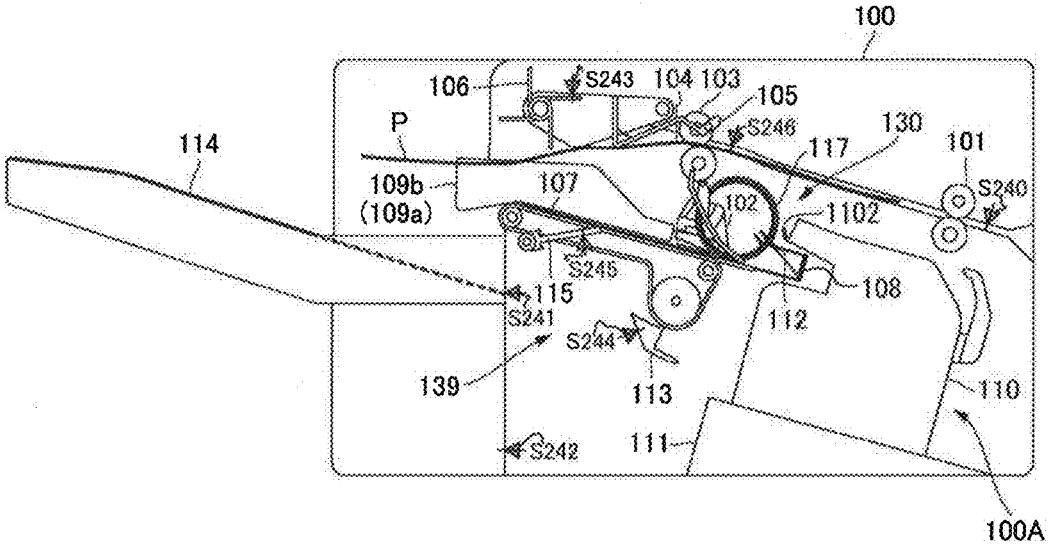
FIGS. 2A and 2B are explanatory views illustrating a finisher serving as the sheet processing apparatus.
Figure 2B:
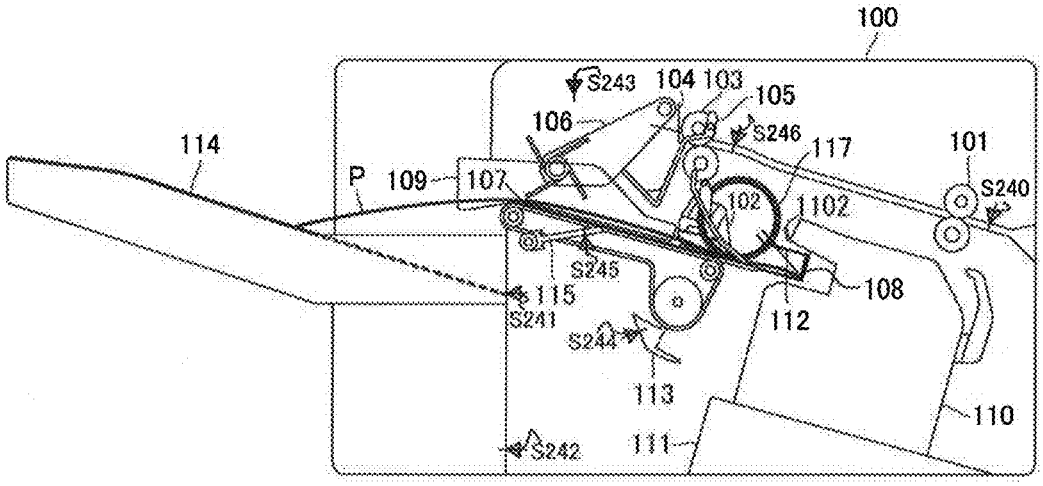

In this case, the finisher 100 performs a process of sequentially taking in the sheets discharged from the apparatus main body 900A and aligning the plurality of sheets thus taken-in to bundle the plurality of sheets into one sheet bundle. In addition, the finisher 100 performs a binding process of binding an end of the sheet bundle on upstream in the sheet discharge direction (hereinafter referred to as "trailing end"). As illustrated in FIGS. 2A and 2B, the finisher 100 includes a processing portion 139 configured to perform the binding process as necessary, and discharging and stacking the sheets on a stacking tray 114. Note that, the processing portion 139 includes an intermediate processing tray 107 serving as a sheet stacking portion on which the sheets to be subjected to the binding process are stacked, and a binding portion 100A configured to bind the sheets stacked on the intermediate processing tray 107.

Figure 3:
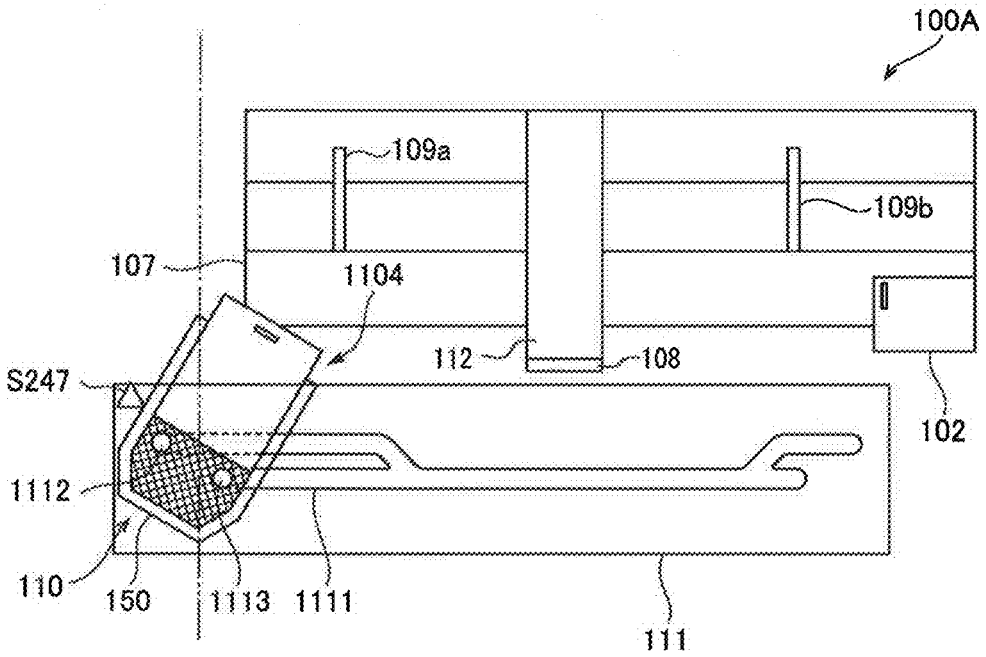
FIG. 3 is an explanatory view illustrating a configuration of a binding portion provided in the finisher.

Further, the intermediate processing tray 107 is provided with a near side aligning plate 109*a* and a far side aligning plate 109*b* which are illustrated in FIG. 3 referred to later, configured to restrict (align) the positions of both side edges in a width direction (lateral direction) of a sheet which has been conveyed to the intermediate processing tray 107 in a direction orthogonal to the lateral direction of the apparatus main body 900A. Note that, the near side aligning plate 109*a* and the far side aligning plate 109*b* serving as a side edge aligning portion configured to align positions of side edges in the width direction of the sheets stacked on the intermediate processing tray 107 move in the width direction by being driven by an aligning motor M253 illustrated in FIG. 9 referred to later.

Further, the near side aligning plate 109*a* and the far side aligning plate 109*b* are generally moved by the aligning motor M253 driven based on a detection signal of an aligning HP sensor (not shown) to a receiving position at which the sheets are received. Then, when the positions of both the side edges of the sheets stacked on the intermediate processing tray 107 are to be restricted, the aligning motor M253 is driven to move the near side aligning plate 109*a* and the far side aligning plate 109*b* in the width direction so that the near side aligning plate 109*a* and the far side aligning plate 109*b* abut against both the side edges of the sheets stacked on the intermediate processing tray.

Further, as illustrated in FIGS. 2A and 2B, a pull-in paddle 106 is arranged above the intermediate processing tray 107 on downstream in the sheet conveyance direction. In this case, before the sheet enters the processing portion 139, a paddle raising and lowering motor M252 is driven based on detection information from a paddle HP sensor S243 illustrated in FIG. 9 referred to later so that the pull-in paddle 106 is set to a wait state at an upper position so as not to interfere with the sheet to be discharged.

Further, after the sheets are discharged onto the intermediate processing tray 107, the pull-in paddle 106 is moved downward due to the reverse drive of the paddle raising and lowering motor M252, and is rotated in a counterclockwise direction at an appropriate timing by a paddle motor (not shown). With this rotation, the pull-in paddle 106 pulls in the sheets so that trailing edges of the sheets are hit against a trailing edge stopper 108. In this embodiment, the pull-in paddle 106, the trailing edge stopper 108, the near side aligning plate 109*a*, and the far side aligning plate 109*b* constitute an aligning portion 130 configured to align the sheets stacked on the intermediate processing tray 107. Note that, for example, when the intermediate processing tray 107 is steep, the sheets can abut against the trailing edge stopper 108 without using the pull-in paddle 106 or a knurled belt 117 to be described later.

Note that, in FIGS. 2A and 2B, a trailing edge assist 112 is illustrated. The trailing edge assist 112 is moved from such a position that the trailing edge assist 112 does not inhibit the movement of a stapler to be described later to a receiving position configured to receive the sheets by an assist motor M254 which is driven based on a detection signal of an assist HP sensor S244 illustrated in FIG. 9 referred to later. Then, after the sheet bundle is subjected to the binding process as described later, the trailing edge assist 112 discharges the sheet bundle onto the stacking tray 114.

Further, the finisher 100 includes an inlet roller pair 101 configured to introduce the sheets inside the apparatus, and delivery rollers 103. The sheets discharged from the apparatus main body 900A are passed to the inlet roller pair 101. Note that, at this time, the passing timing of the sheet is simultaneously detected by an inlet sensor S240. Then, the sheets passed to the inlet roller pair 101 are sequentially discharged onto the intermediate processing tray 107 by the delivery rollers 103 serving as a sheet discharging portion. After that, by a moving unit such as the pull-in paddle 106 and the knurled belt 117, the sheets are hit against the trailing edge stopper 108. With this, the sheets are aligned in the sheet conveyance direction, and the sheet bundle that has undergone the aligning process is formed.

Note that, a trailing end dropper 105 is pushed upward by the sheet passing through the delivery rollers 103 as illustrated in FIG. 2A. Then, after the sheet P passes through the delivery rollers 103, the trailing end dropper 105 drops by its own weight as illustrated in FIG. 2B to push down the trailing end of the sheet P from above.

Further, a static charge eliminator 104 and a sheet bundle presser 115 are provided. The sheet bundle presser 115 is rotated by a sheet bundle presser motor M255 illustrated in FIG. 9 referred to later, to thereby press the sheet bundle stacked on the stacking tray 114. Further, a tray lower limit sensor S242, a sheet bundle presser home position (HP) sensor S245, and a tray home position (HP) sensor S241 are provided. When the sheet bundle shields the tray HP sensor S241 from light, a tray raising and lowering motor M251 illustrated in FIG. 9 lowers the stacking tray 114 until the tray HP sensor S241 becomes a transmissive state to determine the sheet surface position.

Further, as illustrated in FIG. 3, the binding portion 100A includes a stapler 110 serving as a staple binding portion, and a staple-less binding unit 102 serving as a staple-less binding portion. Note that, FIG. 3 illustrates a state in which the stapler 110 is located at a home position (HP). In this case, the stapler 110 serving as a first binding unit configured to subject the sheets to the binding process with a staple is mounted on a staple support 150.

Note that, the staple support 150 is moved by a STP moving motor M258 illustrated in FIG. 9 referred to later under a state in which guides 1112 and 1113 of the staple support 150 are guided by grooves of a moving guide 1111 provided in a staple moving base 111. With this, the stapler 110 moves on the staple moving base while changing its orientation with respect to the sheet.

Note that, in FIG. 3, a staple (STP) HP sensor S247 configured to detect the home position (HP) of the movable stapler 110 is illustrated. In this embodiment, the HP of the stapler 110 is set on the near side with respect to the intermediate processing tray 107 in the lateral direction of the apparatus main body 900A (hereinafter referred to as "near side of the apparatus main body"). By setting the home position of the stapler 110 on the near side of the apparatus main body 900A, the U-shaped staple can be easily replaced.

Figure 4:
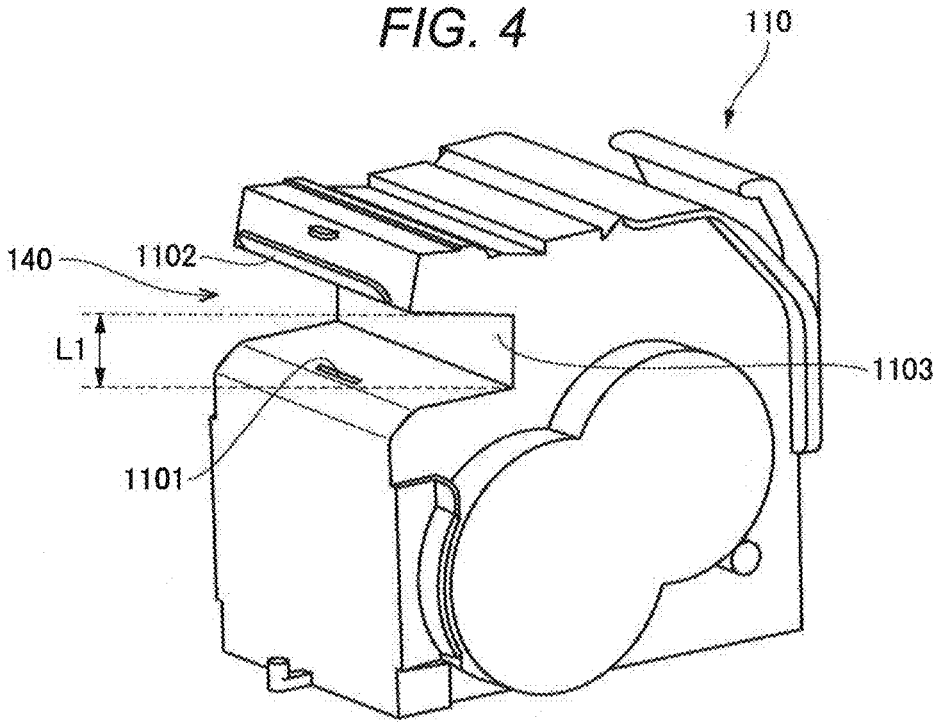
FIG. 4 is an explanatory view illustrating a configuration of a stapler provided in the binding portion.

In this case, as illustrated in FIG. 4, the stapler 110 serving as the staple binding portion includes a driving portion 1101 configured to drive the staple, an anvil portion 1102 configured to bend the driven staple, and a jaw portion 1103 which connects the driving portion 1101 and the anvil portion 1102 to each other. The stapler 110 drives the staple from the driving portion 1101 by a STP motor M256 illustrated in FIG. 9 referred to later in a direction from the back surface to the front surface of the sheet bundle on the intermediate processing tray 107. Then, the anvil portion 1102 bends the leading end part of the driven staple by 90° to perform staple binding.

Further, when the sheet bundle to be subjected to staple binding is received, in other words, when a driving operation is not performed, the driving portion 1101 and the anvil portion 1102 wait while maintaining a gap L1 therebetween so as to enable entrance of sheets between the driving portion 1101 and the anvil portion 1102. As an example of the size of the gap L1, when the number of sheets to be subjected to binding is 50, the gap L1 is set to 20 mm to enable the reception of the sheets. This is set considering air layers or the like formed between the sheets when the sheets are stacked, while the thickness of a sheet bundle of 50 sheets each being 64 g/m$^2$ is about 5 mm. In other words, in this embodiment, the stapler 110 has an opening 140 serving as a first receiving portion whose width (gap) in a thickness direction for receiving the sheet bundle discharged onto the intermediate processing tray 107 is 20 mm.

Figure 5A:
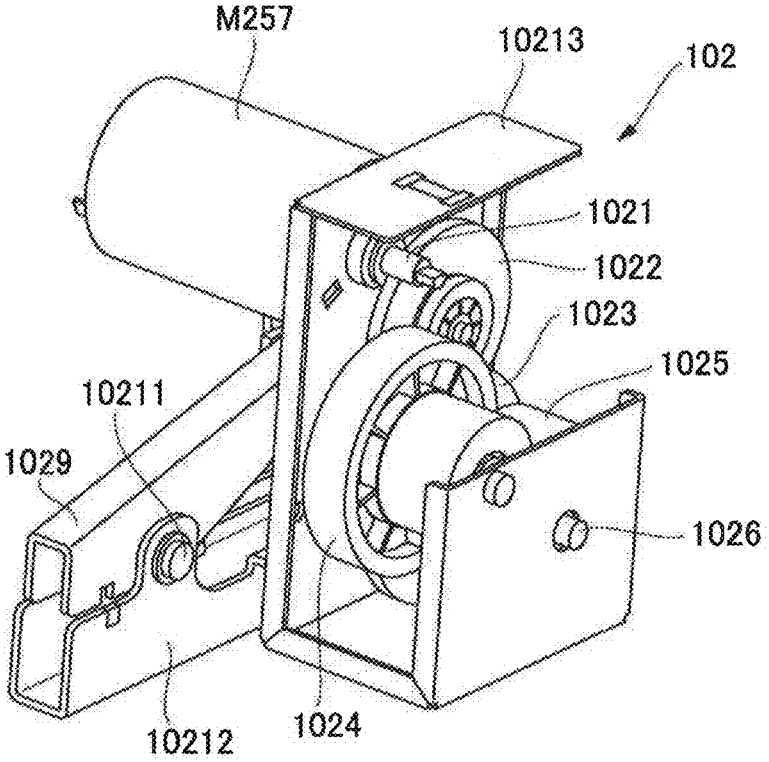
FIGS. 5A and 5B are explanatory views illustrating a configuration of a staple-less binding unit provided in the binding portion.

As illustrated in FIG. 3, the staple-less binding unit 102 serving as a second binding unit configured to subject the sheets to the binding process without using a staple is provided on the far side with respect to the intermediate processing tray 107 in the lateral direction of the apparatus main body 900A (hereinafter referred to as "far side of the apparatus main body"). Further, as illustrated in FIG. 5A, the staple-less binding unit 102 includes a staple-less binding motor M257, a gear 1021 which is rotated by the staple-less binding motor M257, and stepped gears 1022 to 1024 which are rotated by the gear 1021. The staple-less binding unit 102 further includes a gear 1025 which is rotated by the stepped gears 1022 to 1024. The staple-less binding unit 102 further includes a lower arm 10212 fixed to a frame 10213, and an upper arm 1029 provided to the lower arm 10212 so as to be swingable about a shaft 10211. The upper arm 1029 is biased toward the lower arm by a biasing member (not shown).

Figure 5B:
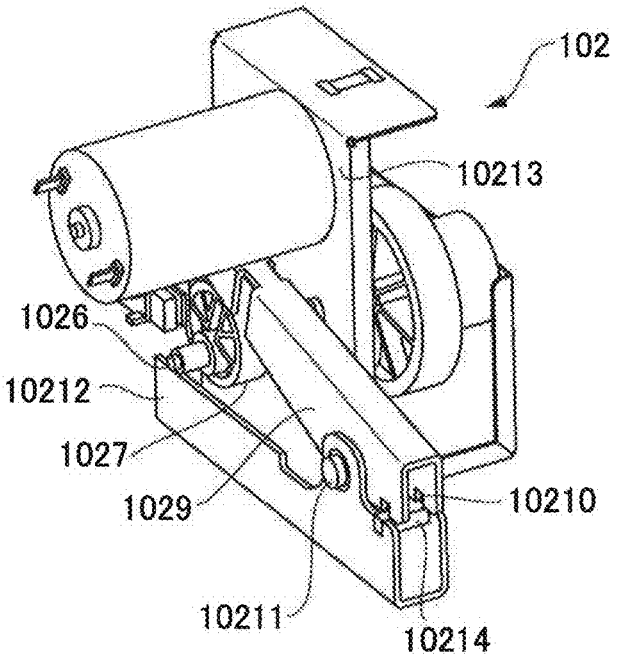

In this case, the gear 1025 is mounted to a rotational shaft 1026. As illustrated in FIG. 5B, a cam 1027 is mounted to the rotational shaft 1026, and the cam 1027 is provided between the upper arm 1029 and the lower arm 10212. With this, when the staple-less binding motor M257 is rotated, the rotation of the staple-less binding motor M257 is transmitted via the gear 1021, the stepped gears 1022 to 1024, and the gear 1025 to the rotational shaft 1026 so that the cam 1027 is rotated.

Figure 6A:
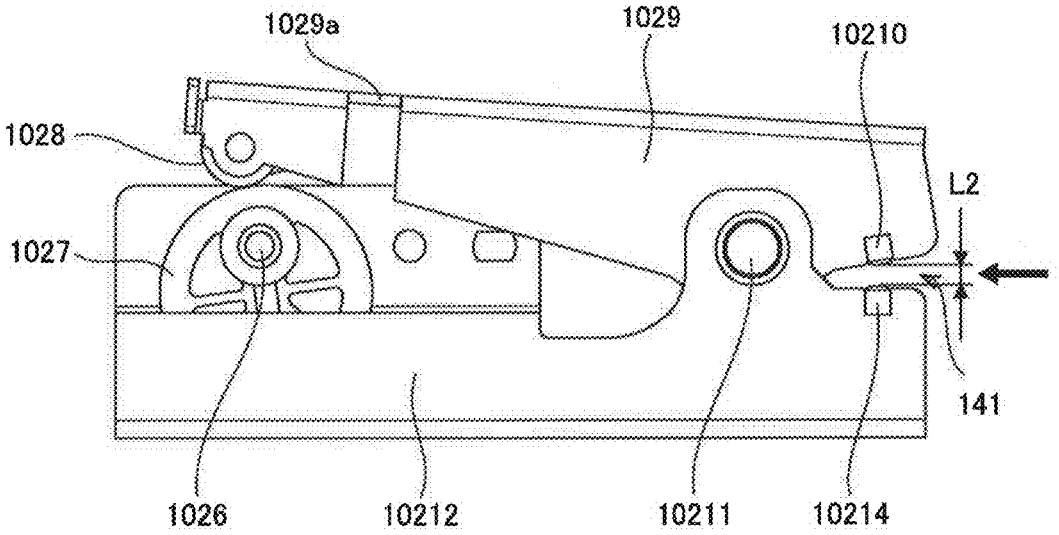
FIGS. 6A and 6B are explanatory views illustrating an operation of the staple-less binding unit provided in the binding portion.
Figure 6B:
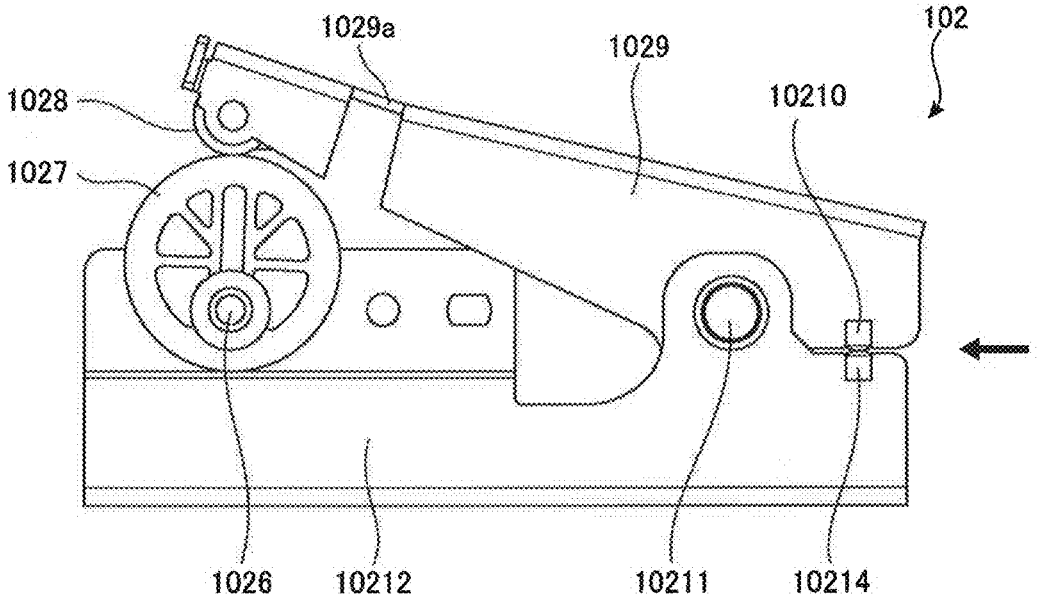
Figure 7:
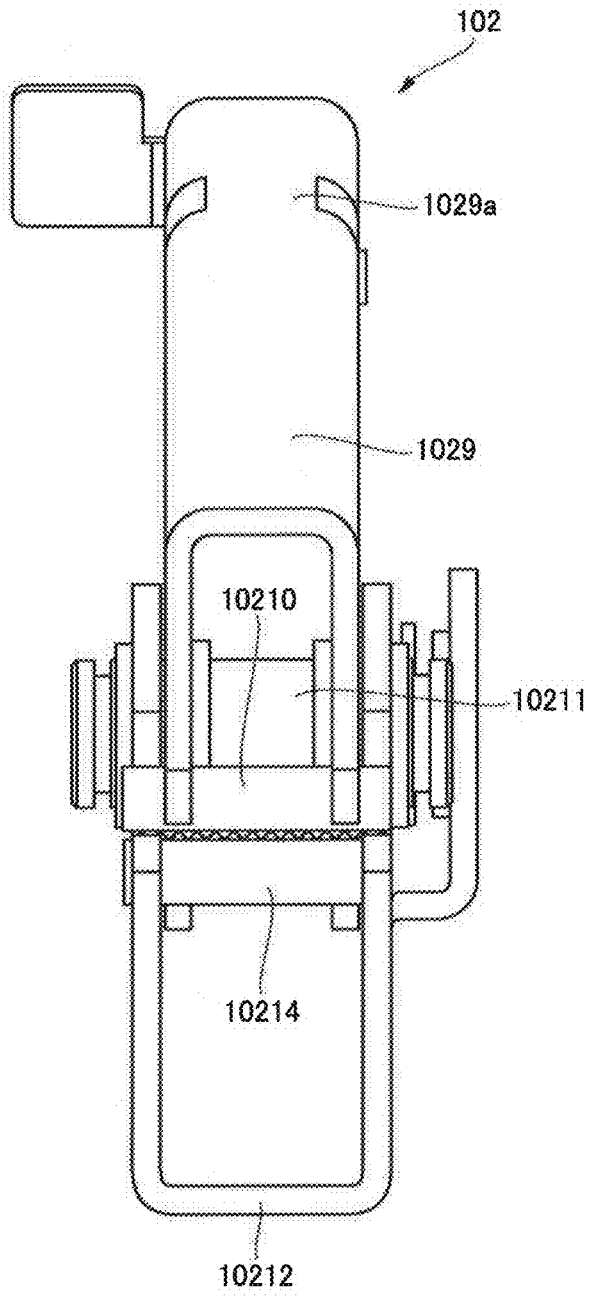
FIG. 7 is an explanatory view illustrating the configuration of the staple-less binding unit provided in the binding portion.

When the cam 1027 is rotated as described above, a cam-side end portion of the upper arm 1029 which has been brought into pressure-contact with the cam 1027 by the biasing member (not shown) via a roller 1028 by then as illustrated in FIG. 6A is raised as illustrates in FIG. 6B. In this case, an upper tooth 10210 is mounted to a lower end of an end portion of the upper arm 1029 on a side opposite to the cam 1027, and a lower tooth 10214 is mounted to an upper end of an end portion of the lower arm 10212 on the side opposite to the cam 1027. Note that, FIG. 7 is a view seen from the direction indicated by an arrow of FIG. 6B. Each of the lower tooth 10214 and the upper tooth 10210 has a concave and convex portion.

With this, when the cam-side end portion of the upper arm 1029 is raised, the end portion of the upper arm 1029 on the side opposite to the cam 1027 is lowered. Accordingly, the upper tooth 10210 is lowered to mesh with the lower tooth 10214, to thereby pressurize the sheets. When the sheets are pressurized as described above, the sheets P are stretched so that the fibers on the surfaces are exposed. With further pressurization, the fibers of the sheets tangle with each other, and thus the sheets are fastened. In other words, when the sheets are subjected to the binding process, the upper arm 1029 is swung, and thus the upper tooth 10210 of the upper arm 1029 and the lower tooth 10214 of the lower arm 10212 mesh with each other to pressurize the sheets. In this manner, the sheets are fastened.

Figure 8:
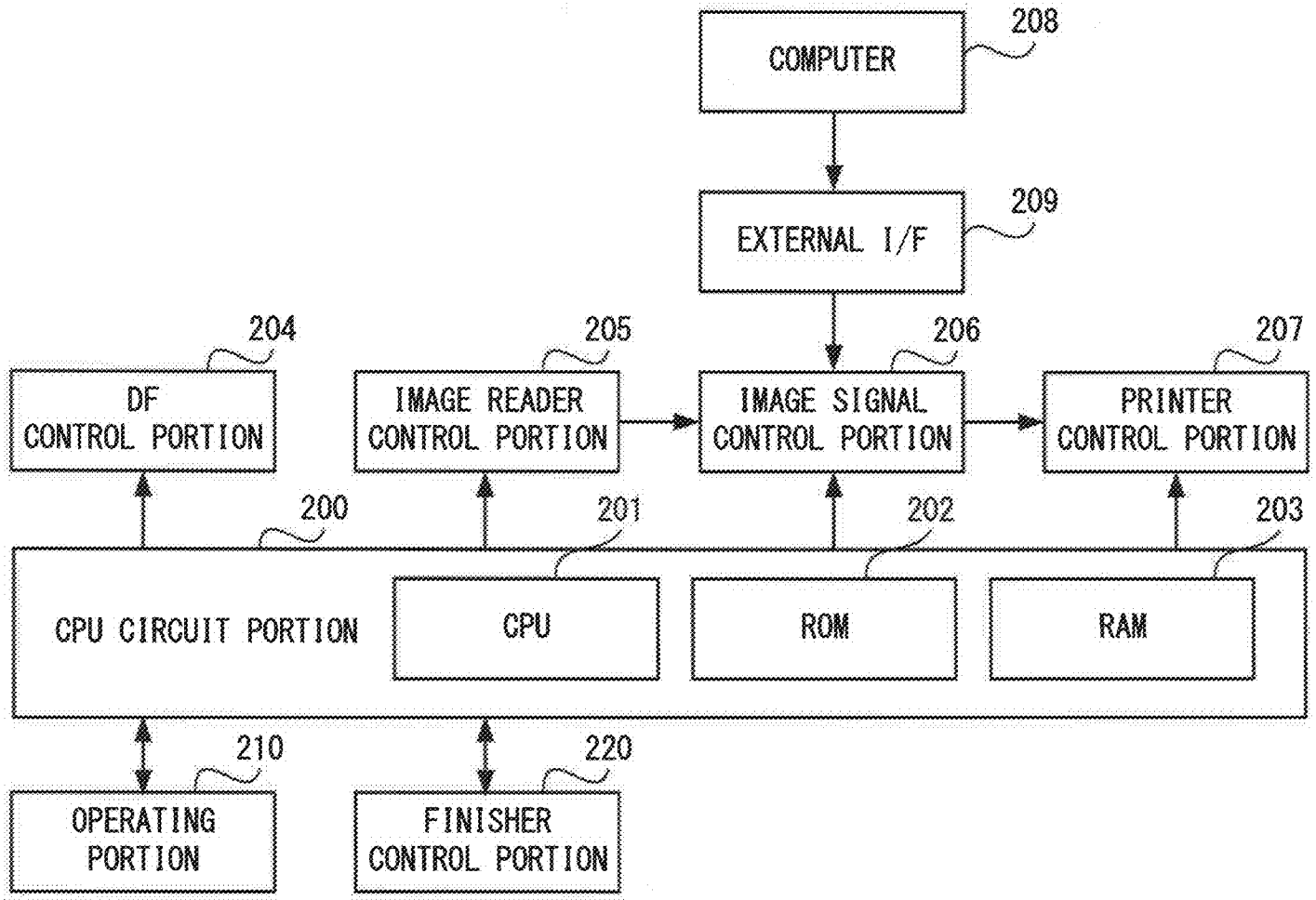
FIG. 8 is a control block diagram of the image forming apparatus.

FIG. 8 is a control block diagram of the image forming apparatus 900. In FIG. 8, the CPU circuit portion 200 is illustrated, which is arranged at a predetermined position of the apparatus main body 900A as illustrated in FIG. 1. The CPU circuit portion 200 includes a CPU 201, a ROM 202 having a control program or the like stored thereon, and a RAM 203 used as a region for temporarily storing control data or as an operation region for calculation performed along control.

Further, in FIG. 8, an external interface 209 for the image forming apparatus 900 and an external PC (computer) 208 is illustrated. When the external interface 209 receives print data from the external PC 208, the external interface 209 develops the data to a bitmap image, and outputs the bitmap image as image data to an image signal control portion 206.

Then, the image signal control portion 206 outputs the data to a printer control portion 207, and the printer control portion 207 outputs the data from the image signal control portion 206 to an exposure control portion (not shown). Note that, image data of a document read by an image sensor (not shown) provided in the image reading apparatus 950 is output from an image reader control portion 205 to the image signal control portion 206, and the image signal control portion 206 outputs the image data to the printer control portion 207.

Further, an operating portion 210 includes a display portion configured to display the setting state and a plurality of keys configured to set various functions relating to image formation. The operating portion 210 outputs, to the CPU circuit portion 200, a key signal corresponding to the operation of each key performed by a user, and displays, on the display portion, corresponding information based on the signal from the CPU circuit portion 200.

The CPU circuit portion 200 controls the image signal control portion 206 in accordance with the control program stored in the ROM 202 and the setting obtained through the operating portion 210, and controls the document feeder 950A (see FIG. 1) via a document feeder (DF) control portion 204. Further, the CPU circuit portion 200 controls the image reading apparatus 950 (see FIG. 1) via the image reader control portion 205, controls the image forming portion 900B (see FIG. 1) via the printer control portion 207, and controls the finisher 100 via a finisher control portion 220.

Note that, in this embodiment, the finisher control portion 220 is mounted to the finisher 100, and performs control to drive the finisher 100 by exchanging information with the CPU circuit portion 200. Alternatively, the finisher control portion 220 may be provided integrally with the CPU circuit portion 200 on the apparatus main body side, to thereby control the finisher 100 directly from the apparatus main body side.

Figure 9:
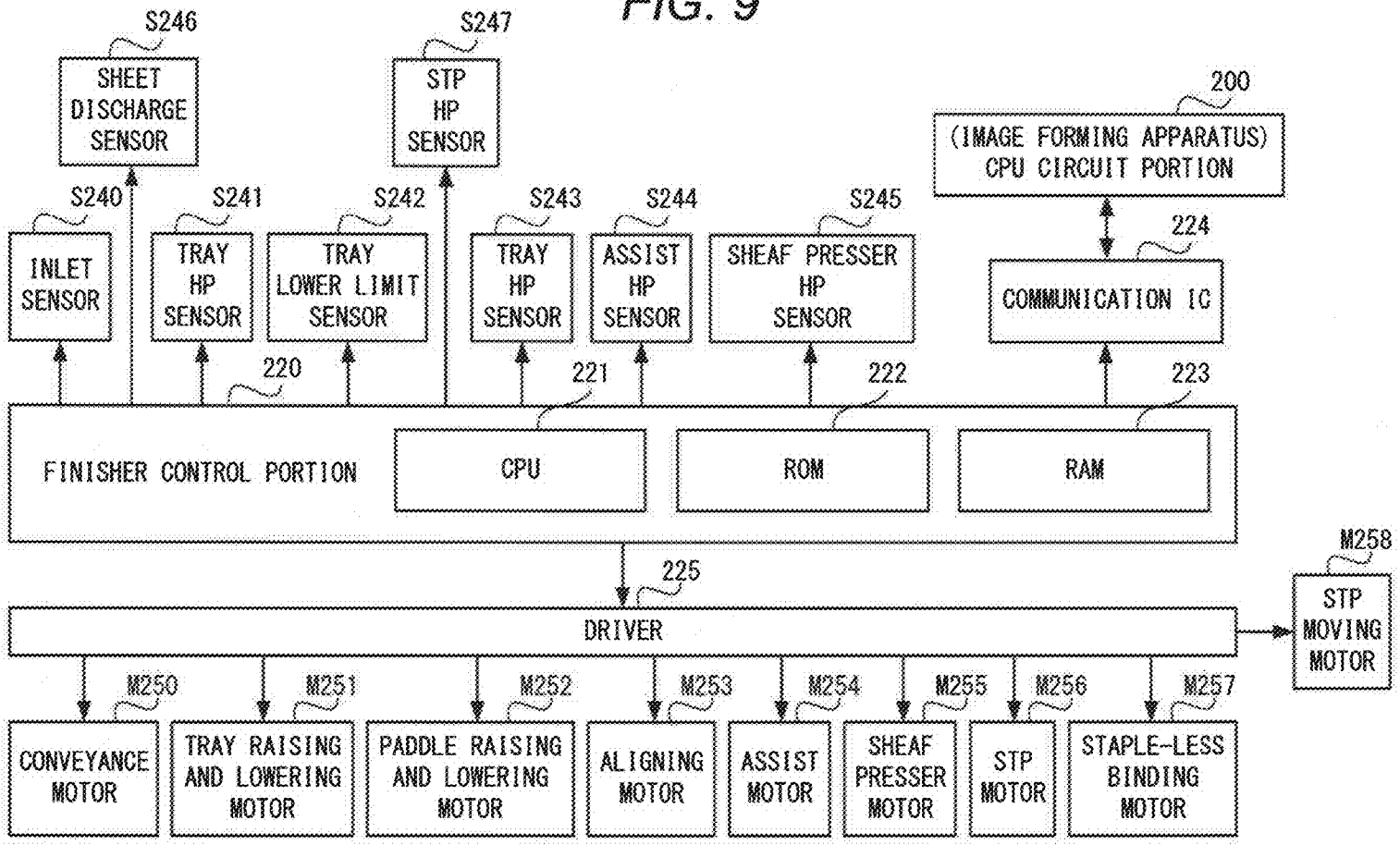
FIG. 9 is a control block diagram of the finisher.

FIG. 9 is a control block diagram of the finisher 100 according to this embodiment. The finisher control portion 220 includes a CPU (microcomputer) 221, a ROM 222, and a RAM 223. The finisher control portion 220 communicates with the CPU circuit portion 200 via a communication IC 224 to exchange data, and executes various programs stored in the ROM 222 based on the instruction from the CPU circuit portion 200 to control the drive of the finisher 100.

Further, the finisher control portion 220 drives, via a driver 225, a conveyance motor M250, the tray raising and lowering motor M251, the paddle raising and lowering motor M252, the aligning motor M253, the assist motor M254, and the sheet bundle presser motor M255. Further, the finisher control portion 220 drives, via the driver 225, the STP motor M256, the staple-less binding motor M257, and the like.

Further, the finisher control portion is connected to the inlet sensor S240, a sheet discharge sensor S246, the tray HP sensor S241, the tray lower limit sensor S242, the paddle HP sensor S243, and the assist HP sensor S244. Further, the finisher control portion 220 is connected to the sheet bundle presser HP sensor S245 and the STP HP sensor S247. The finisher control portion 220 drives the aligning motor M253, the STP moving motor M258, the staple-less binding motor M257, and the like based on the detection signals from the respective sensors.

By the way, when the sheets are subjected to staple-less binding, the finisher control portion 220 configured to control such an operation of the staple-less binding unit 102 first detects the cam position by a sensor (not shown). Then, at the time of reception of the sheets before the staple-less binding, the finisher control portion 220 controls the rotation of the staple-less binding motor M257 so that the cam 1027 is located at a bottom dead center as illustrated in FIG. 6A.

Note that, when the cam 1027 is located at the bottom dead center, a gap L2 is generated between the upper tooth 10210 and the lower tooth 10214, to thereby allow entrance of a plurality of sheets to be subjected to staple-less binding.

At this time, the gap L2 between the upper tooth 10210 and the lower tooth 10214 is provided to be slightly wider than the number of sheets to be fastened. As an example, when the number of sheets to be fastened is 5, the gap L2 between the upper tooth 10210 and the lower tooth 10214 is 3 mm, which allows the entrance of the sheets. This is set considering air layers or the like formed between the sheets when the sheets are stacked, while the thickness of a sheet bundle of 5 sheets each being 64 g/m$^2$ is about 0.5 mm. In other words, in this embodiment, as illustrated in FIG. 6A referred to later, the staple-less binding unit 102 has an opening 141 as a second receiving portion whose width (gap) in a thickness direction for receiving the sheet bundle discharged onto the intermediate processing tray 107 is 3 mm.

Further, during the binding operation, the staple-less binding motor M257 is rotated, and the upper arm 1029 is swung by the cam 1027 clockwise about the shaft 10211. Then, when the cam 1027 is located at a top dead center as illustrated in FIG. 6B, the upper tooth 10210 of the upper arm 1029 and the lower tooth 10214 of the lower arm 10212 mesh with each other. With this, the sheets are fastened.

Figure 10:
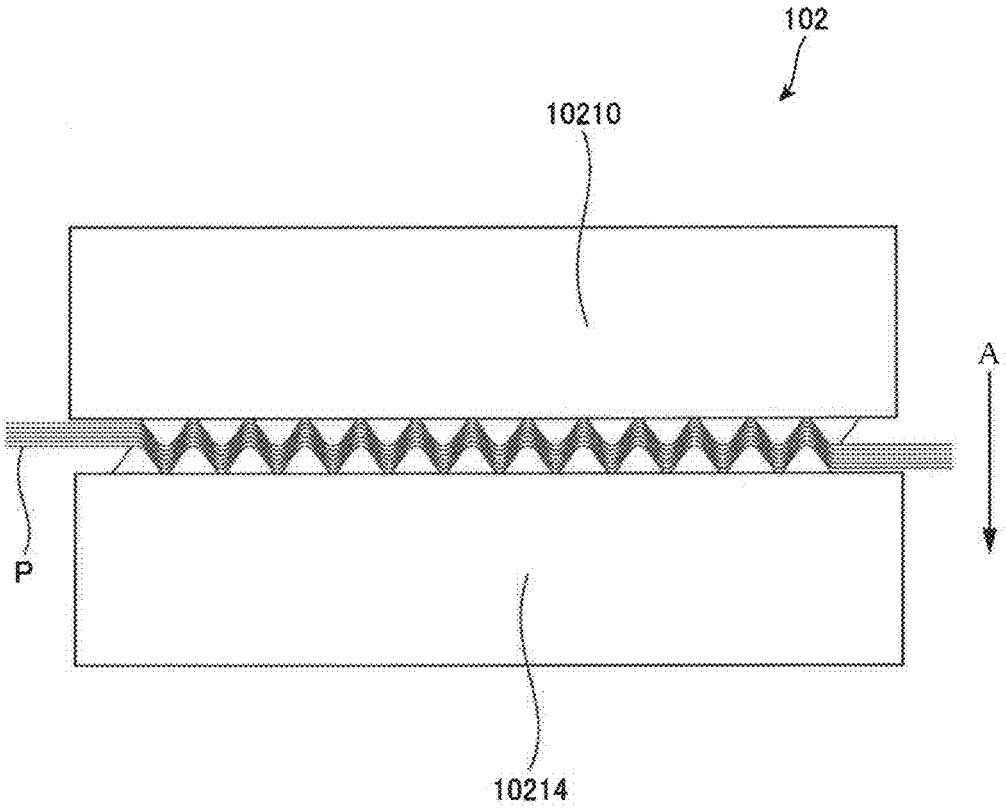
FIG. 10 is a sectional view illustrating a state of sheets subjected to staple-less binding by the staple-less binding unit.

Note that, when the cam 1027 is further rotated after the cam 1027 is located at the top dead center, a flexure portion 1029*a* provided in the upper arm 1029 may warp so that the roller 1028 can climb over the top dead center of the cam 1027. Further, after that, when the cam 1027 is further rotated to arrive at the bottom dead center again, a sensor (not shown) detects the cam 1027, and thus the finisher control portion 220 stops the rotation of the staple-less binding motor M257. FIG. 10 is a view illustrating a state of a sheet bundle of 5 sheets P which has undergone staple-less binding by the staple-less binding unit 102. The sheets are pressurized to have a concave and convex shape by the upper tooth 10210 and the lower tooth 10214. In this manner, the fibers of the sheets P tangle with each other to fasten the sheets P.

Next, a sheet binding process operation of the finisher 100 according to the embodiment will be described. As illustrated in FIG. 2A referred to above, the sheets P discharged from the image forming apparatus 900 are passed to the inlet roller pair 101 which is driven by the conveyance motor M250. At this time, the leading edge of the sheet P is detected by the inlet sensor S240 to simultaneously detect the passing timing of the sheet.

Next, the sheet P passed to the inlet roller pair 101 is passed from the inlet roller pair 101 to the delivery rollers 103. The sheet P is conveyed while the leading edge of the sheet P raises the trailing end dropper 105, and simultaneously, the static charge is eliminated by the static charge eliminator 104. In this state, the sheet P is discharged onto the intermediate processing tray 107. The sheet P discharged onto the intermediate processing tray 107 by the delivery rollers 103 is pressed from above by the trailing end dropper 105 with its own weight. In this manner, the time for dropping the trailing end of the sheet P onto the intermediate processing tray 107 is reduced.

Next, based on the signal of a trailing edge of the sheet P detected by the sheet discharge sensor S246, the finisher control portion 220 performs control in the intermediate processing tray 107. That is, as illustrated in FIG. 2B referred to above, the paddle raising and lowering motor M252 lowers the pull-in paddle 106 toward the intermediate processing tray 107 so that the pull-in paddle 106 comes into contact with the sheet P. At this time, the pull-in paddle 106 is rotated in a counterclockwise direction by the conveyance motor M250, and hence the sheet P is conveyed toward the trailing edge stopper 108 in the right direction in FIG. 2B by the pull-in paddle 106. After that, the trailing edge of the sheet P is passed to the knurled belt 117. Note that, when the trailing edge of the sheet P is passed to the knurled belt 117, the paddle raising and lowering motor M252 is driven in a raising direction. When the paddle HP sensor S243 detects that the paddle 106 has arrived at the HP, the finisher control portion 220 stops the driving of the paddle raising and lowering motor M252.

Figure 11A:
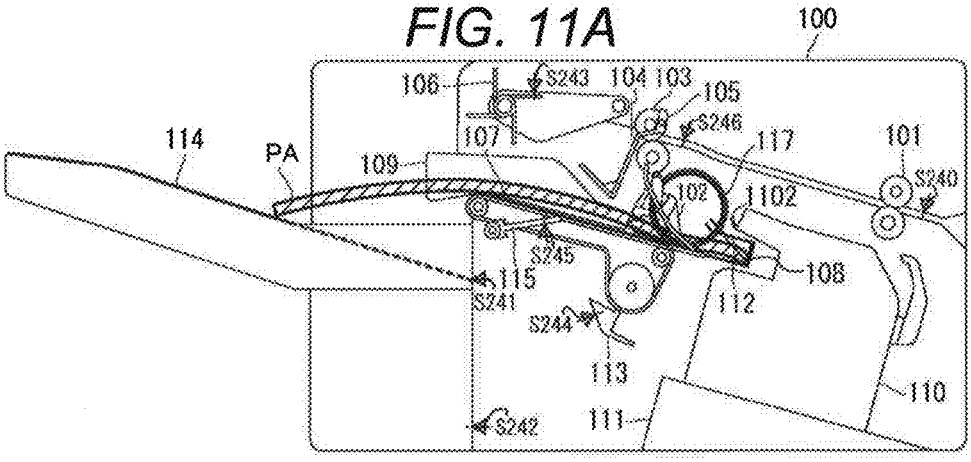
FIGS. 11A, 11B, and 11C are explanatory views illustrating an operation of a sheet binding process of the finisher.

The knurled belt 117, served as a moving unit, conveys the sheet P which has been conveyed by the pull-in paddle 106 to the trailing edge stopper 108, and then rotates while slipping with respect to the sheet P, to thereby constantly bias the sheet P against the trailing edge stopper 108. With this slipping rotation, the sheet P can be hit against the trailing edge stopper 108, and thus the skew of the sheet P can be corrected. Next, after the sheet P abuts against the trailing edge stopper 108 as described above, the finisher control portion 220 drives the aligning motor M253 to move the aligning plates 109 in the width direction orthogonal to the sheet discharge direction, to thereby align the sheet P in the width direction. This series of operations is repeated with respect to a predetermined number of sheets to be subjected to the binding process. In this manner, as illustrated in FIG. 11A, a sheet bundle PA aligned on the intermediate processing tray 107 is formed in a state of the sheets entering the opening 140 of the stapler 110.

Figure 11B:
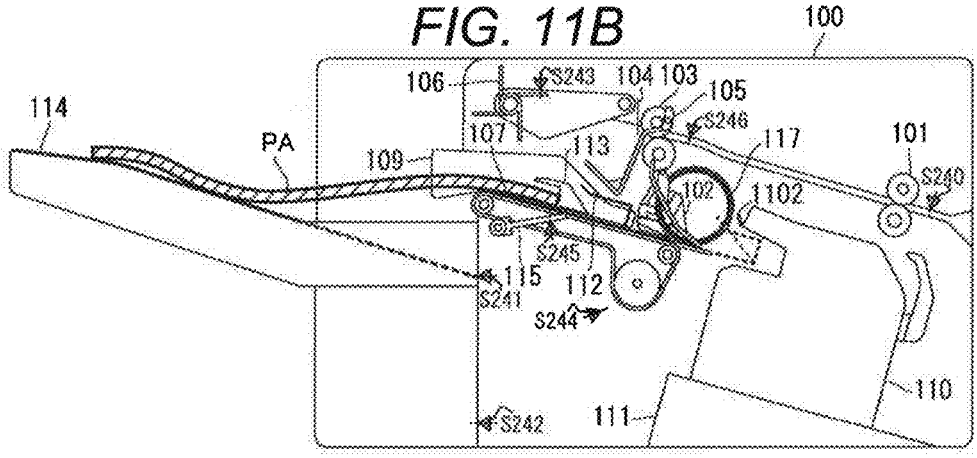

Next, after such an aligning operation is performed, when a binding mode is selected, the binding portion performs the binding process. After that, as illustrated in FIG. 11B, the trailing edge assist 112 and a discharge claw 113 which are driven by the same assist motor M254 and serve as the sheet discharging portion push the trailing edge of the sheet bundle PA. Thus, the sheet bundle PA on the intermediate processing tray 107 is discharged onto the stacking tray 114 in a bundle state.

Figure 11C:
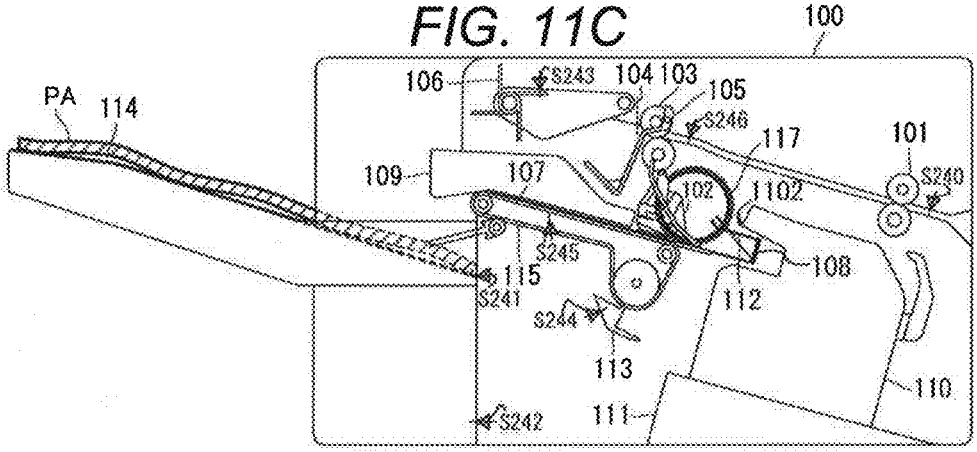

Note that, after that, as illustrated in FIG. 11C, in order to prevent the sheet bundle PA stacked on the stacking tray 114 from being pushed out in the sheet conveyance direction by a sheet bundle to be subsequently discharged, the sheet bundle presser 115 is rotated counterclockwise to press the trailing end of the sheet bundle PA. Then, after the sheet bundle presser 115 completes the sheet bundle pressing operation, when the sheet bundle PA shields the tray HP sensor S241 from light, the tray raising and lowering motor M251 lowers the stacking tray 114 until the tray HP sensor S241 becomes a transmissive state, to thereby determine the sheet surface position. The series of operations is repeated, and thus a necessary number of sets of the sheet bundle PA can be discharged onto the stacking tray 114.

Note that, during operation, when the stacking tray 114 is lowered to shield the tray lower limit sensor S242 from light, a full stacking state of the stacking tray 114 is noted from the finisher control portion 220 to the CPU circuit portion 200 of the image forming apparatus 900, to thereby suspend the image formation. After the sheaves of sheets on the stacking tray 114 are removed, the stacking tray 114 is raised until the stacking tray 114 shields the tray HP sensor S241 from light. Then, the stacking tray 114 is lowered so that the tray HP sensor S241 becomes a transmissive state to determine the position of the surface of the stacking tray 114 again. With this, the image formation of the image forming apparatus 900 is restarted.

By the way, in this embodiment, as described above and illustrated in FIG. 3, the binding portion 100A includes the stapler 110 and the staple-less binding unit 102. Then, when the binding mode is selected, the user selects one of a staple job for binding the sheets with the staple, and a staple-less binding job for binding the sheets by staple-less binding.

Figure 12A:
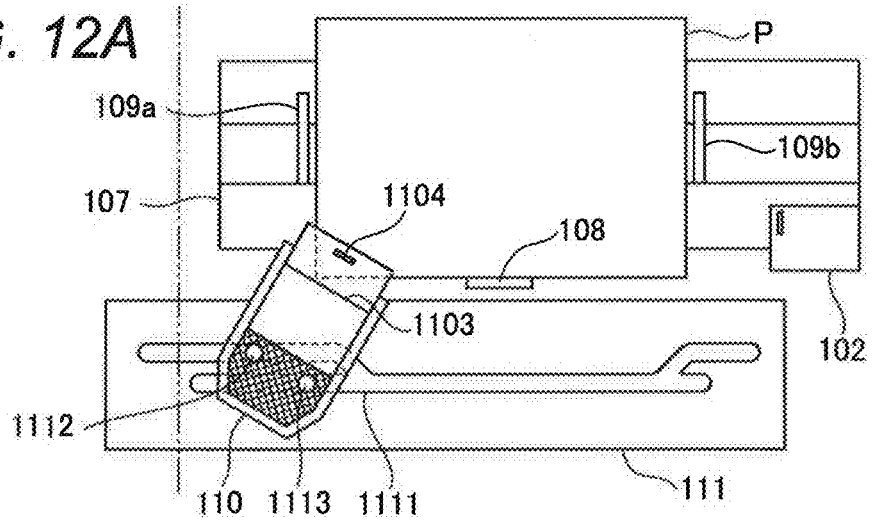
FIGS. 12A, 12B, and 12C are explanatory views illustrating a binding process performed by the stapler provided in the finisher.

Then, for example, when the user selects the staple job, the finisher control portion 220 drives the STP moving motor M258 to move the stapler 110 from the HP illustrated in FIG. 3 referred to above to a near side binding position with respect to the sheet P illustrated in FIG. 12A. The sheet discharged by the delivery rollers 103 under this state is applied with a force by the pull-in paddle 106 in a direction opposite to the sheet conveyance direction so that the trailing edge of the sheet P returns back to the trailing edge stopper 108.

After the trailing edge of the sheet P is returned back to the trailing edge stopper 108, the near side aligning plate 109*a* and the far side aligning plate 109*b* correct the sheet P in the width direction. After that, the knurled belt 117 performs returning in the sheet conveyance direction. This aligning operation is performed correspondingly to the number of sheets to be subjected to the binding process, and then the stapler 110 performs the binding process with a staple with respect to a staple position 1104 of the sheets P. After that, the sheet bundle subjected to the binding process on the intermediate processing tray 107 is discharged onto the stacking tray 114 by the trailing edge assist 112.

Figure 12B:
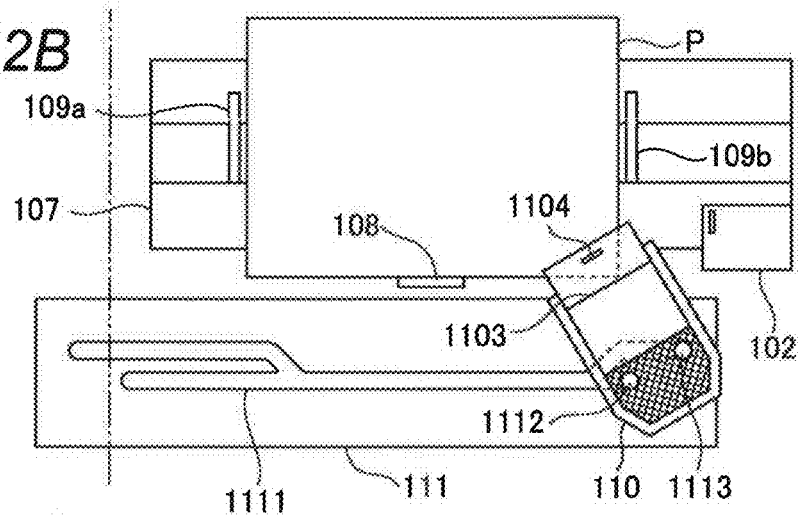
Figure 12C:
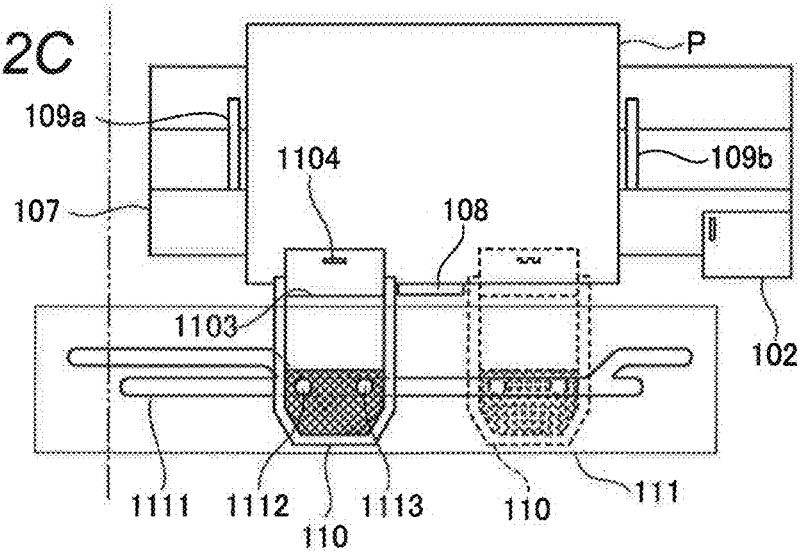

Note that, in this embodiment, the case where the sheet P is subjected to near side binding will be described, but when the stapler 110 is caused to wait on the far side of the apparatus main body as illustrated in FIG. 12B, far side binding becomes possible. Further, in a case of two-position binding, the stapler 110 is first caused to wait at the staple position on one side as illustrated in FIG. 12C, and then the sheet bundle is subjected to the staple process. Next, the stapler 110 is moved by the STP moving motor M258 to another binding position indicated by the broken lines to subject the sheet bundle to the staple process. In this manner, the two-position binding can be performed. In other words, in this embodiment, the stapler 110 is movable along the sheet bundle PA, and capable of performing a binding process at a plurality of binding positions corresponding to each binding mode.

Figure 13:
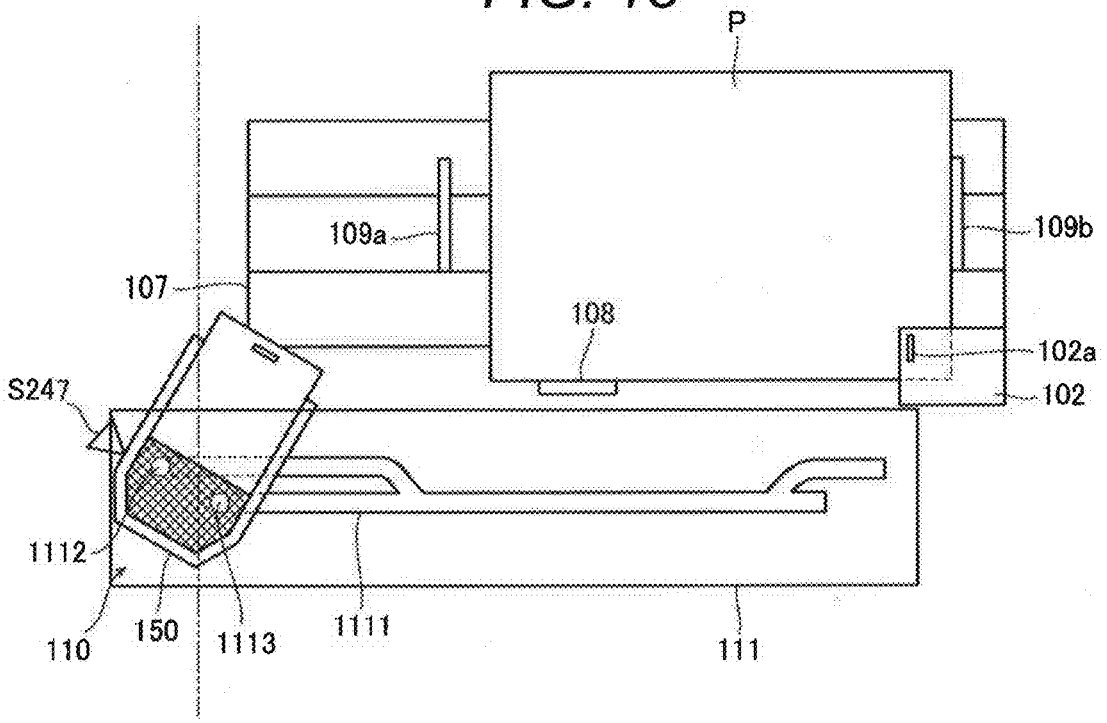
FIG. 13 is an explanatory view illustrating a binding process performed by the staple-less binding unit.

On the other hand, when the user selects the staple-less binding job, first, the far side aligning plate 109*b* serving as a first aligning plate moves from an initial position illustrated in FIG. 3 referred to above to wait at a position at which the staple-less binding unit 102 on the far side (the side of the second binding unit) of the apparatus main body illustrated in FIG. 13 can perform staple-less binding. Under this state, the sheet P discharged onto the intermediate processing tray 107 is applied with a force by the pull-in paddle 106 in a direction opposite to the sheet conveyance direction. Further, with the conveyance by the knurled belt 117, the sheet trailing edge is returned back to the trailing edge stopper 108.

Next, after the sheet trailing edge is returned back to the trailing edge stopper 108 as described above, the near side aligning plate 109*a* serving as a second aligning plate is moved in the width direction so that the sheet is hit against the far side aligning plate 109*b*. In this manner, the sheet is subjected to the aligning operation in the width direction. With this, at the time of the staple-less binding job, the sheet bundle can be aligned at an alignment position (second alignment position) on the staple-less binding unit side with respect to an alignment position (first alignment position) when the stapler 110 performs the binding process illustrated in FIGS. 12A, 12B, and 12C referred to above. After that, the knurled belt 117 performs returning in the sheet conveyance direction. Then, the aligning operation is performed with respect to a predetermined number of sheets to be subjected to the binding process. After that, the staple-less binding unit 102 performs the binding operation to the sheet bundle, and thus the staple-less binding process is performed at a predetermined binding position 102*a*. As described above, in this embodiment, the second alignment position is set as the binding process position for the staple-less binding unit 102. The staple-less binding unit 102 is arranged outside a moving region of the stapler 110 (a region in which sheets having the maximum width are to be stacked).

By the way, in this embodiment, as illustrated in FIG. 3 referred to above, the staple-less binding unit 102 is arranged on upstream with respect to the stapler 110 in a moving direction in which the sheet moved by the pull-in paddle 106 and the knurled belt 117 as a moving unit. Further, as described above, the opening 141 of the staple-less binding unit 102 has a gap in a sheet thickness direction, which is smaller than that of the opening 140 of the stapler 110. Therefore, when the staple-less binding unit 102 is arranged on upstream with respect to the stapler 110 in the sheet moving direction, depending on the arrangement position, in a case of binding the sheet bundle by the stapler 110, the staple-less binding unit 102 may interfere with the sheet bundle to be bound.

Therefore, in this embodiment, the staple-less binding unit 102 is arranged outside a region in which sheets having the maximum width, which are to be subjected to the binding process by the stapler 110, are to be stacked (see FIGS. 12A to 12C). In other words, in this embodiment, when the stapler 110 performs the binding process, the staple-less binding unit 102 is arranged at a position shifted in the width direction from a region on the intermediate processing tray (a sheet stacking portion), through which the sheets discharged by the delivery rollers 103 pass. In other words, the staple-less binding unit 102 is arranged in a position at which the sheets moved into the opening 140 do not enter the opening 141 of the staple-less binding unit 102.

With this, when the stapler 110 performs the binding of the sheet bundle, it is possible to prevent the staple-less binding unit 102 having the opening 141 with a gap in the sheet thickness direction, which is smaller than that of the opening 140 of the stapler 110, from interfering with the sheet bundle to be bound by the stapler 110. As a result, even when the stapler 110 and the staple-less binding unit 102 which differ in opening height are used, the finisher 100 can perform the binding process without using a selective moving mechanism and without limiting the number of sheets to be bound to be smaller than the ability of the binding unit. In other words, the finisher 100 can perform the binding process without upsizing the apparatus and lowering the binding process efficiency.

By the way, in the description above, the HP of the stapler 110 is set on the near side of the apparatus main body 900A, but the present invention is not limited thereto. The HP of the stapler 110 may be set on the far side of the apparatus main body 900A.

Figure 14:
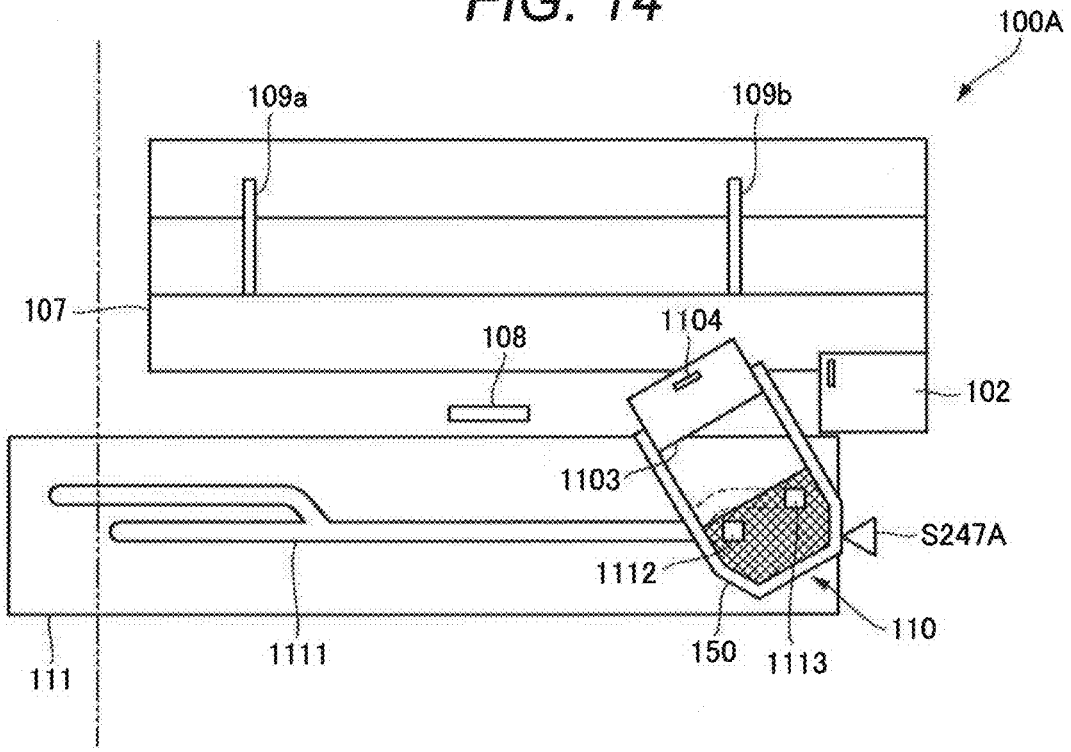
FIG. 14 is an explanatory view illustrating a configuration of a binding portion provided in a finisher serving as a sheet processing apparatus according to a second embodiment of the present invention.

Next, a second embodiment of the present invention will be described, in which the HP of the stapler 110 is set on the far side of the apparatus main body 900A. FIG. 14 is a view illustrating a configuration of a binding portion provided in a finisher serving as a sheet processing apparatus according to this embodiment. Note that, in FIG. 14, the same or corresponding parts are denoted by the same reference symbols as those in FIG. 3 referred to above. In FIG. 14, a staple (STP) HP sensor S247A detects the home position (HP) of the movable stapler 110. The STP HP sensor S247A is provided on the far side of the apparatus main body 900A.

Then, when user selects the staple job, the finisher control portion 220 drives the STP moving motor M258 to move the stapler 110 from the HP illustrated in FIG. 14 to the near side binding position with respect to the sheet P illustrated in FIG. 12A referred to above. Further, in the case of the far side binding, the stapler 110 is caused to wait at the HP on the far side of the apparatus main body as illustrated in FIG. 12B referred to above. Further, in a case of two-position binding, the stapler 110 is first caused to wait at the staple position on one side indicated by the broken lines as illustrated in FIG. 12C referred to above, and then the sheet bundle is subjected to the staple process. Next, the stapler 110 is moved by the STP moving motor M258 to another binding position to subject the sheet bundle to the staple process. In this manner, the two-position binding can be performed.

Figure 15A:
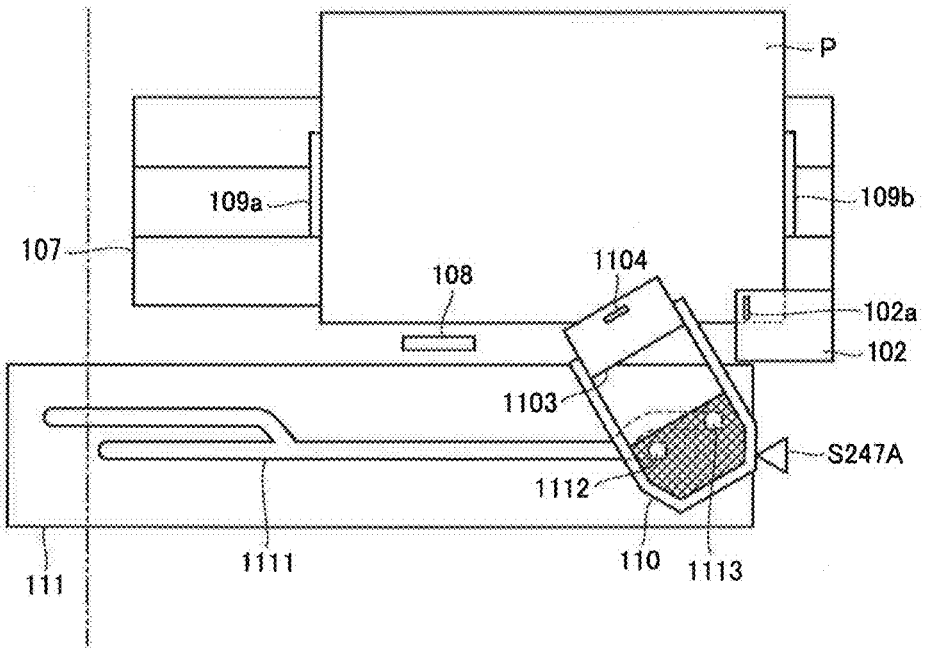
FIGS. 15A and 15B are explanatory views illustrating an operation of a stapler provided in the binding portion before staple-less binding is performed.

On the other hand, when the user selects the staple-less binding job, first, the far side aligning plate 109*b* moves from the initial position illustrated in FIG. 3 referred to above to wait at a position at which the staple-less binding unit 102 on the far side (the side of the second binding unit) of the apparatus main body illustrated in FIG. 15A can perform staple-less binding. Under this state, the sheet P discharged onto the intermediate processing tray 107 is applied with a force by the pull-in paddle 106 in a direction opposite to the sheet conveyance direction. Further, with the conveyance by the knurled belt 117, the sheet trailing edge is returned back to the trailing edge stopper 108.

Next, after the sheet trailing edge is returned back to the trailing edge stopper 108 as described above, the near side aligning plate 109*a* is moved in the width direction so that the sheet is hit against the far side aligning plate 109*b*. In this manner, the sheet is subjected to the aligning operation in the width direction. After that, the knurled belt 117 performs returning in the sheet conveyance direction. Then, the aligning operation is performed with respect to a predetermined number of sheets to be subjected to the binding process. After that, the staple-less binding unit 102 performs the binding operation to the sheet bundle, and thus the staple-less binding process is performed at a predetermined binding position.

Note that, also in this embodiment, the staple-less binding unit 102 is arranged outside a region in which sheets having the maximum width, which are to be subjected to the binding process by the stapler 110, are to be stacked. When the staple-less binding unit 102 is arranged at such a position, it is possible to prevent the sheet bundle to be bound by the stapler 110 from entering the opening of the staple-less binding unit 102.

By the way, in the case where the stapler 110 is located at the HP in the vicinity of the staple-less binding unit 102 as in this embodiment, when the staple-less binding is performed, the jaw portion 1103 of the stapler 110 interferes with the sheets to be subjected to the staple-less binding, and hence the sheets cannot be aligned. Therefore, when the staple-less binding is performed, the stapler 110 is moved to a position at which the jaw portion 1103 does not interfere with the sheets to be subjected to the staple-less binding. Specifically, when the staple-less binding is performed, before the sheets are conveyed, the stapler 110 is moved from the HP illustrated in FIG. 15A to a position for near side binding (solid line) or a position for two-position binding (broken lines) illustrated in FIG. 15B.

Then, when the staple-less binding is performed, by moving the stapler 110 to positions described above, the staple-less binding unit 102 can align the sheets without being interfered with the stapler 110. Note that, the retracting position of the stapler 110 is not limited to such positions, and may be any position as long as the jaw portion 1103 does not interfere with the sheets to be subjected to the staple-less binding, in other words, the binding process of the staple-less binding unit 102 is not inhibited.

Figure 16:
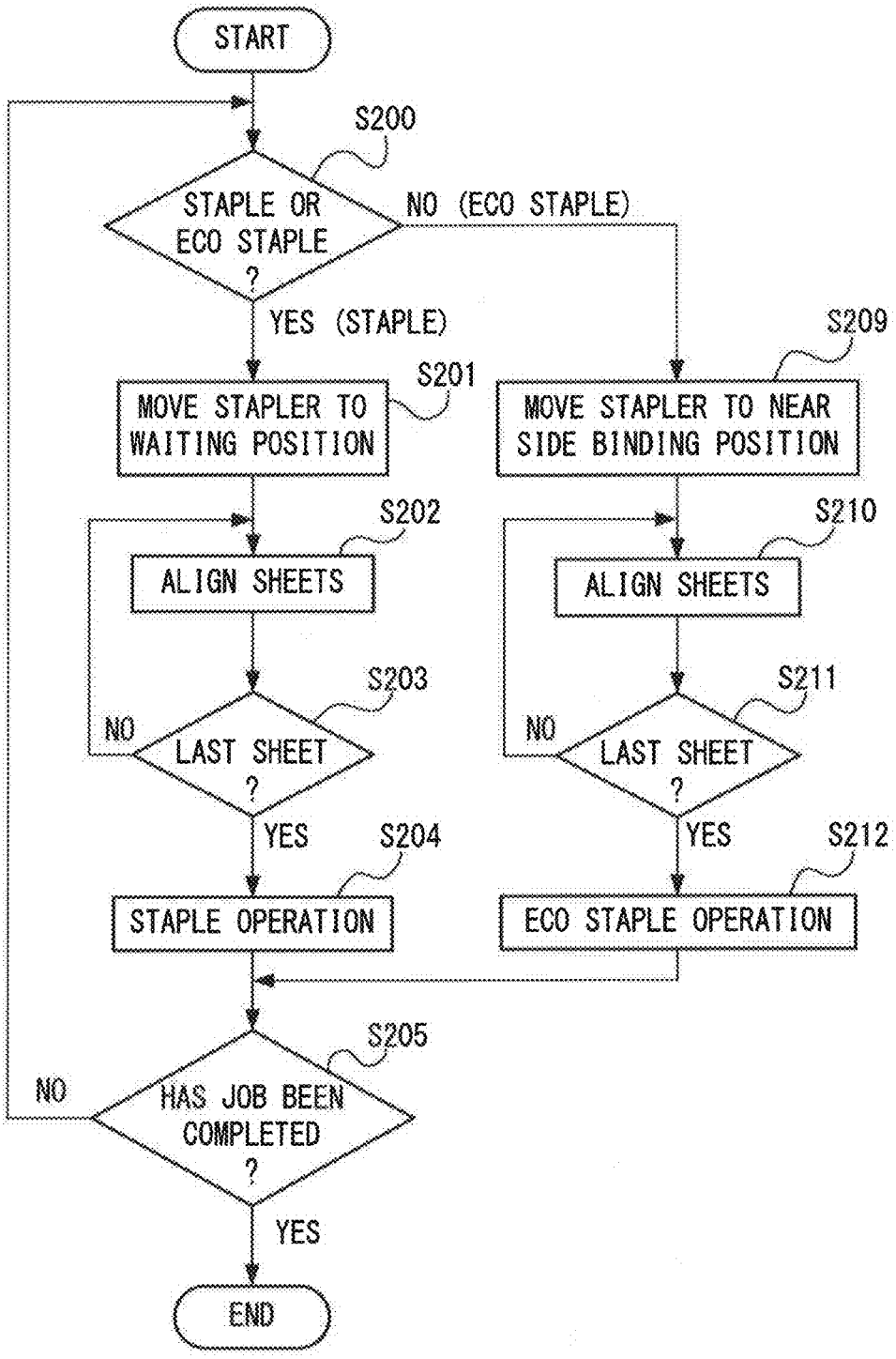
FIG. 16 is a flow chart illustrating a binding operation of the finisher.

Note that, FIG. 16 is a flow chart illustrating the binding operation of such a finisher 100 according to this embodiment. When the job is started, the CPU circuit portion 200 of the image forming apparatus 900 sends, to the finisher control portion 220, information on any one of a job of performing binding of sheets with the staple and a job of performing binding of sheets by staple-less binding. In this case, when the job is a staple job (YES in Step S200), the stapler 110 is moved by the STP moving motor M258 to the near side binding position, the far side binding position, or the two-binding position illustrated in FIGS. 12A, 12B, and 12C referred to above, and caused to wait at the corresponding position.

Next, after the stapler 110 is moved to the waiting position as described above (Step S201), at the processing portion 139, a predetermined number of sheets to be subjected to the binding process are stacked and aligned (Step S202). Then, after the alignment of the last sheet as the final sheet is completed (YES in Step S203), the stapler 110 performs the staple operation (Step S204). With this, the sheet bundle is subjected to the staple process. Note that, after that, it is determined whether or not the job has been completed with this process (Step S205), and until the job is completed (NO in Step S205), Steps S200 to S204 are repeated. When the job is completed (YES in Step S205), the binding operation is ended.

Figure 15B:
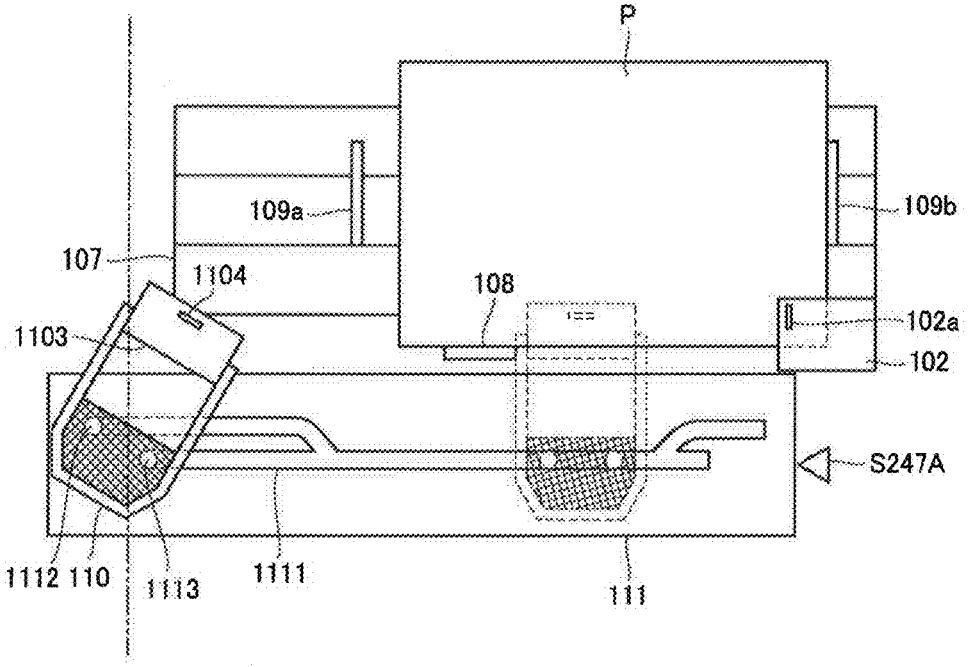

On the other hand, when the job is an eco staple, that is, when the job is the staple-less binding job (NO in Step S200), the stapler 110 is moved from the HP illustrated in FIG. 14 to the near side binding position illustrated in FIG. 15B (Step S209). After that, the far side aligning plate 109*b* is caused to wait at the waiting position on the far side of the apparatus main body, and the near side aligning plate 109*a* is moved in the width direction. With this, at the processing portion 139, a predetermined number of sheets to be subjected to the binding process are stacked and aligned (Step S210).

Then, after the alignment of the last sheet as the final sheet is completed (YES in Step S211), the staple-less binding unit 102 performs the eco staple operation (Step S212). With this, the sheet bundle is subjected to the staple-less binding process. Then, it is determined whether or not the job has been completed with this process (Step S205), and until the job is completed (NO in Step S205), Steps S200 and S209 to S212 are repeated. When the job is completed (YES in Step S205), the binding operation is ended.

In the case where the HP of the stapler 110 is set on the far side of the apparatus main body 900A as described above, when the staple-less binding job is performed, the stapler 110 is moved to a position at which the stapler 110 does not interfere with the sheets to be subjected to staple-less binding. In other words, in the case of the staple-less binding job, the stapler 110 is moved to such a position in which the stapler 110 does not inhibit the staple-less binding of the staple-less binding unit 102. With this, even when the stapler 110 and the staple-less binding unit 102 which differ in opening height are used, the finisher 100 can perform the binding process without upsizing the apparatus and lowering the binding process efficiency.

Note that, in the above, there is described a case in which, when the job is the eco staple, the near side aligning plate 109*a* is moved for each sheet so that the sheet abuts against the far side aligning plate 109*b* to form the sheet bundle, and the binding is performed at the position at which the sheet bundle is formed. However, the present invention is not limited thereto. For example, the sheet bundle may be formed at a position in which the sheet bundle does not enter the opening 141 in the eco staple, and then the near side aligning plate 109*a* and the far side aligning plate 109*b* may be moved while maintaining a gap of a sheet width, to thereby introduce the sheets into the opening 141.

Next, a third embodiment of the present invention will be described with reference to FIGS. 17A, 17B, and 18 and a flow chart illustrated in FIG. 19. Note that, in FIGS. 17A, 17B, and 18, the same or corresponding parts are denoted by the same reference symbols as those in FIGS. 12A to 12C and 14 referred to above.

When the job is started, the CPU circuit portion 200 of the image forming apparatus 900 sends, to the finisher control portion 220, information on any one of a job of performing binding of sheets with the staple and a job of performing binding of sheets by staple-less binding. In this case, when the job is a staple job (YES in Step S300), the stapler 110 is moved by the STP moving motor M258 to the near side binding position, the far side binding position, or the two-binding position illustrated in FIGS. 12A, 12B, and 12C referred to above, and caused to wait at the corresponding position.

Next, after the stapler 110 is moved to the waiting position as described above (Step S301), at the processing portion 139, a predetermined number of sheets to be subjected to the binding process are stacked and aligned (Step S302). Then, after the alignment of the last sheet as the final sheet is completed (YES in Step S303), the stapler 110 performs the staple operation (Step S304). With this, the sheet bundle is subjected to the staple process. Note that, after that, it is determined whether or not the job has been completed with this process (Step S305), and until the job is completed (NO in Step S305), Steps S300 to S304 are repeated. When the job is completed (YES in Step S305), the binding operation is ended.

Figure 17A:
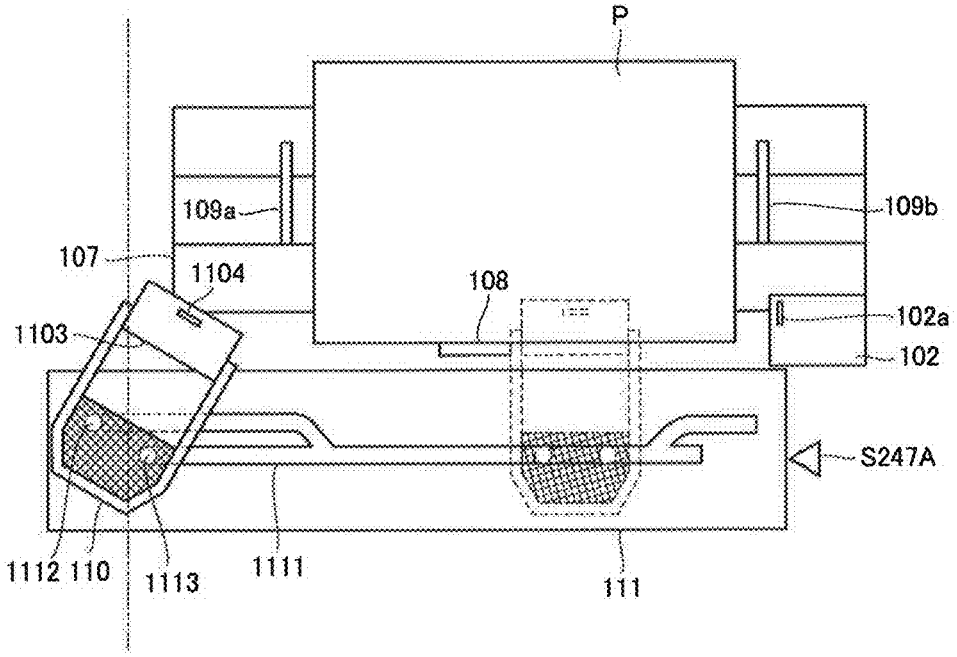
FIGS. 17A and 17B are explanatory views illustrating a binding operation of a finisher serving as a sheet processing apparatus according to a third embodiment of the present invention.
Figure 17B:
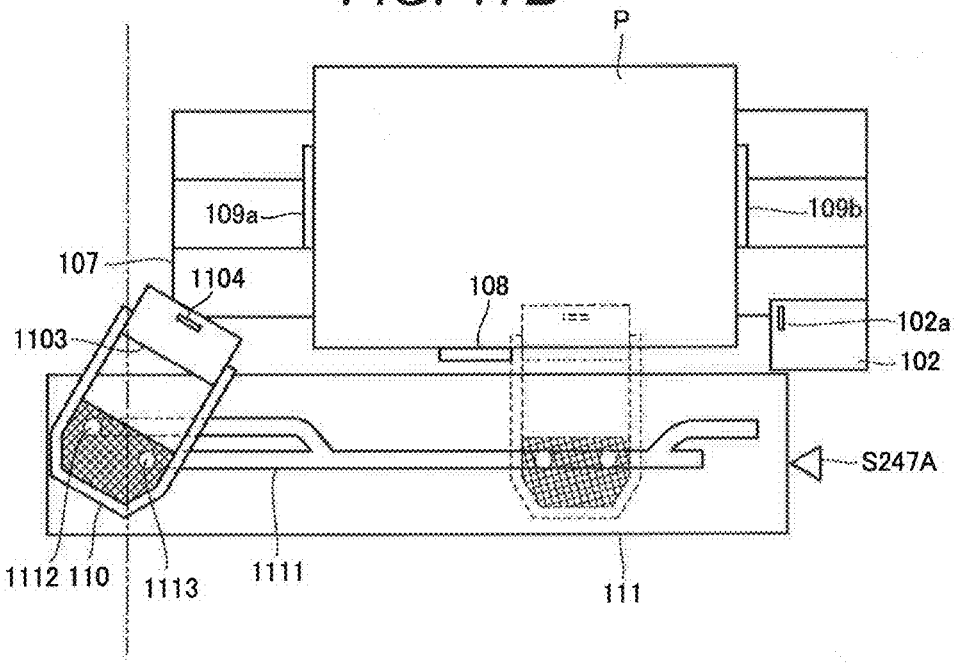

On the other hand, when the job is an eco staple, that is, when the job is the staple-less binding job (NO in Step S300), the stapler 110 is moved from the HP illustrated in FIG. 14 to the near side binding position illustrated in FIG. 17A (Step S309). After that, the near side aligning plate 109*a* and the far side aligning plate 109*b* are caused to wait at positions (separate positions) separated by a predetermined amount from the end portions of the discharged sheet P. After that, the aligning plates 109*a* and 109*b* approach to positions abutting against the end portions of the sheet P illustrated in FIG. 17B (abutment positions). Thus, the sheets are aligned. This operation is performed every time the sheet P is discharged. Thus, at the processing portion 139, a predetermined number of sheets to be subjected to binding process are stacked and aligned (Step S310).

Figure 18:
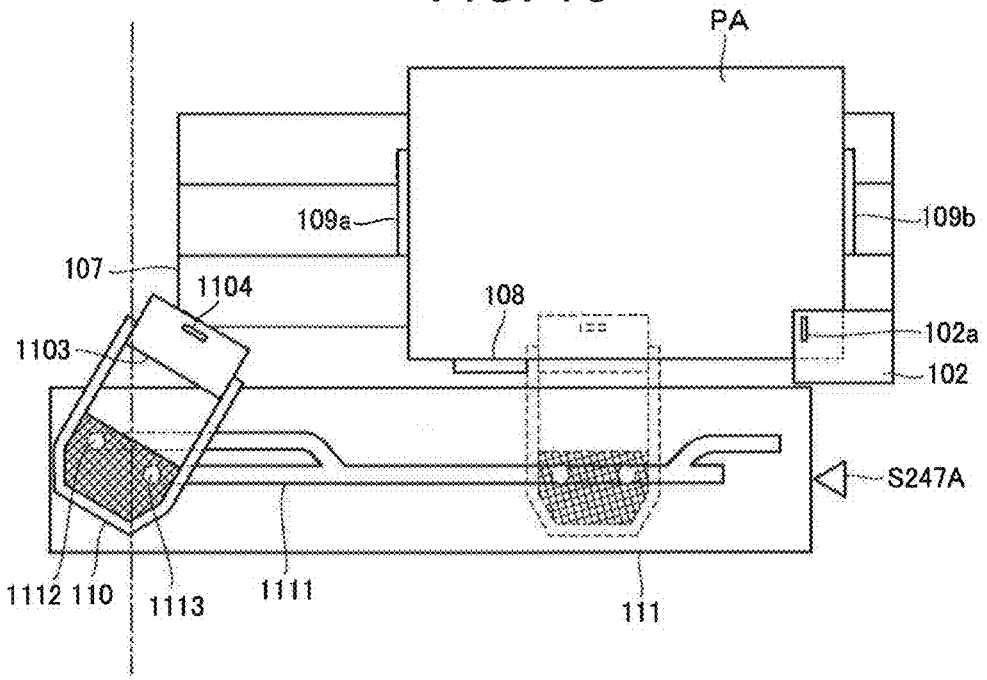
FIG. 18 is an explanatory view illustrating the binding operation of the finisher.
Figure 19:
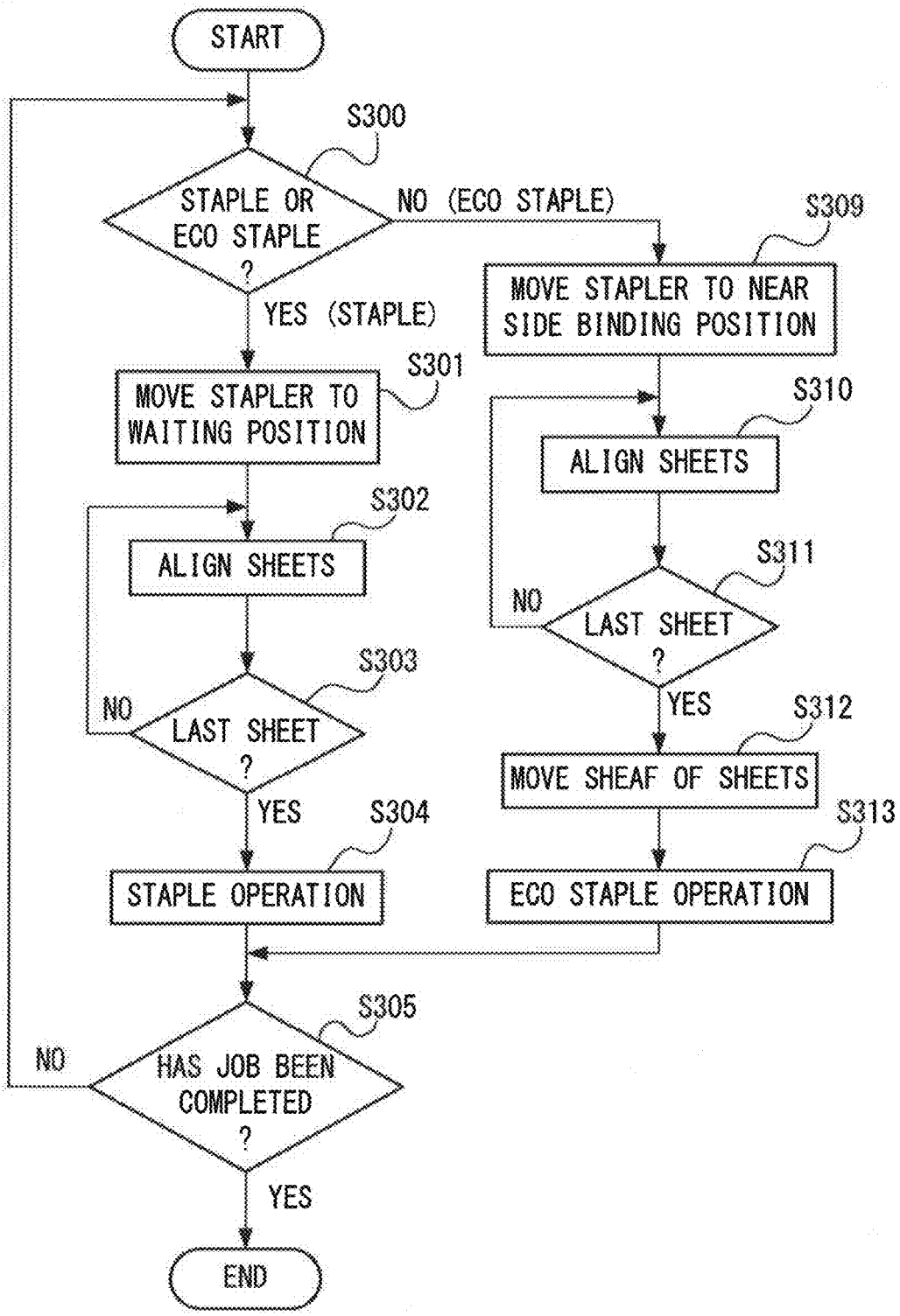
FIG. 19 is a flow chart illustrating the binding operation of the finisher.

Then, after the alignment of the last sheet as the final sheet is completed (YES in Step S311), as illustrated in FIG. 18, the near side aligning plate 109*a* and the far side aligning plate 109*b* move toward the staple-less binding unit 102 while bilaterally constraining both ends of the sheet bundle PA. After the sheet bundle PA is moved by the movement of the near side aligning plate 109*a* and the far side aligning plate 109*b* as described above (Step S312), the staple-less binding unit 102 performs the eco staple operation (Step S313). With this, the sheet bundle is subjected to the staple-less binding process. Then, it is determined whether or not the job has been completed with this process (Step S305), and until the job is completed (NO in Step S305), Steps S300 and S309 to S313 are repeated. When the job is completed (YES in Step S305), the binding operation is ended.

Figure 20:
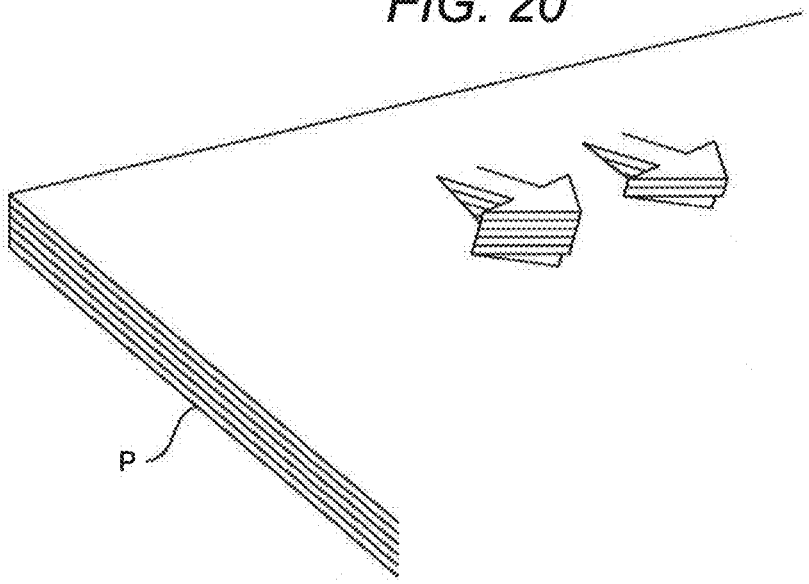
FIG. 20 is a view illustrating a half-blanking shape formed by the staple-less binding unit.

Note that, in the above, there is described a case in which the staple-less binding unit 102 has a tooth shape to form irregularities in the sheet, but the present invention is not limited thereto. For example, as long as the staple-less binding unit has an opening with a gap in the sheet thickness direction, which is smaller than that of the opening of the stapler, the staple-less binding unit may form a half-blanking shape in the sheets P as illustrated in FIG. 20.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-207101, filed Sep. 20, 2012, and Japanese Patent Application No. 2013-165554, filed Aug. 8, 2013, which are hereby incorporated by reference herein in their entirety.

What is claimed is:

1. A sheet processing apparatus, comprising:

a support surface on which a sheet is supported;

a first aligning member configured to contact a first edge on one side, in a sheet width direction, of the sheet supported on the support surface;

a second aligning member configured to contact a second edge on the other side, in the sheet width direction, of the sheet supported on the support surface;

an abutment portion configured to contact a third edge, parallel to the sheet width direction, of the sheet supported on the support surface;

a first binding unit configured to bind first sheets, which are positioned by the abutment portion, the first aligning member, and the second aligning member, with a staple; and a second binding unit configured to bind second sheets, which are positioned by the abutment portion, the first aligning member, and the second aligning member, without using a staple, wherein the first binding unit is movable in the sheet width direction to a plurality of positions, the first binding unit binding the first sheets at a selected position among the plurality of positions, the plurality of positions including a position at which the first binding unit is located when the first binding unit binds a first part in a corner portion, on the one side in the sheet width direction and on a side of the third edge contacting the abutment portion, of the first sheets positioned by the abutment portion, the first aligning member, and the second aligning member, wherein the second binding unit is configured to bind a second part in a corner portion, on the one side in the sheet width direction and on the side of the third edge contacting the abutment portion, of the second sheets positioned by the abutment portion, the first aligning member, and the second aligning member, and wherein at least a part of the first binding unit and at least a part of the second binding unit overlap each other in a direction along the support surface and perpendicular to the sheet width direction as viewed along the sheet width direction at a time when the first binding unit binds the first part in the corner portion, on the one side in the sheet width direction and on the side of the third edge contacting the abutment portion, of the first sheets positioned by the abutment portion, the first aligning member, and the second aligning member.

2. A sheet processing apparatus according to claim 1, wherein the first edge on the one side, in the sheet width direction, of the sheet is positioned closer to the other side than the second binding unit is, at the time when the first binding unit binds the first part in the corner portion, on the one side in the sheet width direction and on the side of the third edge contacting the abutment portion, of the first sheets positioned by the abutment portion, the first aligning member, and the second aligning member.

3. A sheet processing apparatus according to claim 1, wherein at least a part of the first binding unit and at least a part of the second binding unit overlap each other in the direction along the support surface and perpendicular to the sheet width direction as viewed along the sheet width direction at a time when the second binding unit binds the second part in the corner portion, on the one side in the sheet width direction and on the side of the third edge contacting the abutment portion, of the second sheets positioned by the abutment portion, the first aligning member, and the second aligning member.

4. A sheet processing apparatus according to claim 1, wherein the second part to be bound by the second binding unit in the corner portion, on the one side in the sheet width direction and on the side of the third edge contacting the abutment portion, of the second sheets positioned by the abutment portion, the first aligning member, and the second aligning member is, in the sheet width direction, closer to the one side than a position of the second sheets contacting the abutment portion is and is, in a direction along the first edge, closer to the side of the third edge than a position of the second sheets contacting the first aligning member is.

5. A sheet processing apparatus according to claim 1, wherein the second binding unit seizes the second sheets with a pair of members having concave and convex portions and pressurizes the second sheets to bind the second sheets.

6. A sheet processing apparatus according to claim 1, wherein the second binding unit forms a half-blanking shape in the second part of the second sheets to bind the second sheets.

7. A sheet processing apparatus according to claim 1, wherein a home position of the first binding unit is closer to the other side in the sheet width direction than a position of the first binding unit, at the time when the first binding unit binds the first part in the corner portion, on the one side in the sheet width direction and on the side of the third edge contacting the abutment portion, of the first sheets positioned by the abutment portion, the first aligning member, and the second aligning member, is.

8. A sheet processing apparatus according to claim 1, wherein a home position of the first binding unit is closer to the other side in the sheet width direction than the second edge on the other side of the sheet supported on the support surface is.

9. A sheet processing apparatus according to claim 1, further comprising:

a conveyance path through which a sheet is conveyed; and a discharge portion configured to discharge the sheet passing through the conveyance path to the support surface.

10. A sheet processing apparatus according to claim 9, further comprising a conveyance unit configured to contact a topmost sheet of a sheet bundle discharged by the discharge portion and supported on the support surface to convey the topmost sheet toward the abutment portion with the third edge being a downstream edge in a conveyance direction.

11. A sheet processing apparatus according to claim 1, further comprising a stacking portion on which a sheet bundle after binding is stacked, wherein a sheet bundle bound by the first binding unit does not pass through the second binding unit while being moved so as to be stacked on the stacking portion.

12. A sheet processing apparatus according to claim 1, further comprising a controller configured to control an operation of the first aligning member, an operation of the second aligning member, an operation of the first binding unit, and an operation of the second binding unit.

13. A sheet processing apparatus, comprising:

a support surface on which a sheet is supported;

a first aligning member configured to contact a first edge on one side, in a sheet width direction, of the sheet supported on the support surface;

a second aligning member configured to contact a second edge on the other side, in the sheet width direction, of the sheet supported on the support surface;

an abutment portion configured to contact a third edge, parallel to the sheet width direction, of the sheet supported on the support surface;

a first binding unit configured to bind first sheets, in a state positioned by the abutment portion, the first aligning member, and the second aligning member, with a staple; and a second binding unit configured to bind second sheets, in the state positioned by the abutment portion, the first aligning member, and the second aligning member, without using a staple, wherein the first binding unit is movable in the sheet width direction to a plurality of positions, the first binding unit binding the first sheets at a selected position among the plurality of positions, the plurality of positions including a position at which the first binding unit is located when the first binding unit binds a first part in a corner portion, on the one side in the sheet width direction and on a side of the third edge contacting the abutment portion, of the first sheets positioned by the abutment portion, the first aligning member, and the second aligning member, wherein the second binding unit is configured to bind a second part in a corner portion, on the one side in the sheet width direction and on the side of the third edge contacting the abutment portion, of the second sheets positioned by the abutment portion, the first aligning member, and the second aligning member, and wherein a home position of the first binding unit is closer to the other side in the sheet width direction than the second binding unit is.

14. An image forming apparatus comprising:

an image forming portion configured to form an image on a sheet;

a support surface on which the sheet, on which the image is formed by the image forming portion, is supported;

a first aligning member configured to contact a first edge on one side, in a sheet width direction, of the sheet supported on the support surface;

a second aligning member configured to contact a second edge on the other side, in the sheet width direction, of the sheet supported on the support surface;

an abutment portion configured to contact a third edge, parallel to the sheet width direction, of the sheet supported on the support surface;

a first binding unit configured to bind first sheets, which are positioned by the abutment portion, the first aligning member, and the second aligning member, with a staple; and a second binding unit configured to bind second sheets, which are positioned by the abutment portion, the first aligning member, and the second aligning member, without using a staple, wherein the first binding unit is movable in the sheet width direction to a plurality of positions, the first binding unit binding the first sheets at a selected position among the plurality of positions, the plurality of positions including a position at which the first binding unit is located when the first binding unit binds a first part in a corner portion, on the one side in the sheet width direction and on a side of the third edge contacting the abutment portion, of the first sheets positioned by the abutment portion, the first aligning member, and the second aligning member, wherein the second binding unit is configured to bind a second part in a corner portion, on the one side in the sheet width direction and on the side of the third edge contacting the abutment portion, of the second sheets positioned by the abutment portion, the first aligning member, and the second aligning member, and wherein at least a part of the first binding unit and at least a part of the second binding unit overlap each other in a direction along the support surface and perpendicular to the sheet width direction as viewed along the sheet width direction at a time when the first binding unit binds the first part in the corner portion, on the one side in the sheet width direction and on the side of the third edge contacting the abutment portion, of the first sheets positioned by the abutment portion, the first aligning member, and the second aligning member.

* * * * *